US008849554B2

(12) United States Patent
Aubrey et al.

(10) Patent No.: US 8,849,554 B2
(45) Date of Patent: Sep. 30, 2014

(54) HYBRID TRAFFIC SYSTEM AND ASSOCIATED METHOD

(75) Inventors: Ken Aubrey, St. Paul, MN (US); Kiran Govindarajan, Eden Praire, MN (US); Bryan Brudevold, Fridley, MN (US); Craig Anderson, Plymouth, MN (US); Baldur Steingrimsson, Eagan, MN (US)

(73) Assignee: Image Sensing Systems, Inc., St. Paul, MN (US)

( * ) Notice: Subject to any disclaimer, the term of this patent is extended or adjusted under 35 U.S.C. 154(b) by 0 days.

(21) Appl. No.: 13/704,316

(22) PCT Filed: Nov. 15, 2011

(86) PCT No.: PCT/US2011/060726

§ 371 (c)(1),
(2), (4) Date: Dec. 14, 2012

(87) PCT Pub. No.: WO2012/068064

PCT Pub. Date: May 24, 2012

(65) Prior Publication Data

US 2013/0151135 A1 Jun. 13, 2013

Related U.S. Application Data

(60) Provisional application No. 61/413,764, filed on Nov. 15, 2010.

(51) Int. Cl.
*G08G 1/00* (2006.01)
*G08G 1/01* (2006.01)

(52) U.S. Cl.
CPC ..... *G08G 1/00* (2013.01); *G08G 1/0116* (2013.01)
USPC ..... 701/118; 701/117; 340/933; 340/937

(58) Field of Classification Search
CPC ..... G08G 1/00
USPC ..... 701/117, 118; 340/933
See application file for complete search history.

(56) References Cited

U.S. PATENT DOCUMENTS 4,697,185 A 9/1987 Thomas et al.
4,988,994 A 1/1991 Loeven (Continued)

FOREIGN PATENT DOCUMENTS

DE 19632252 B4 3/2006
EP 0761522 A1 3/1997

(Continued)

OTHER PUBLICATIONS

"Vehicle Detection", from http://www.mobileye.com/manufacturer-products/applications/forwa . . . , visited Oct. 11, 2010, 1 page.

(Continued)

*Primary Examiner* — Thomas G Black
*Assistant Examiner* — Wae Louie
(74) *Attorney, Agent, or Firm* — Brooks, Cameron & Huebsch, PLLC

(57) ABSTRACT

A traffic sensing system for sensing traffic at a roadway includes a first sensor having a first field of view, a second sensor having a second field of view, and a controller. The first and second fields of view at least partially overlap in a common field of view over a portion of the roadway, and the first sensor and the second sensor provide different sensing modalities. The controller is configured to select a sensor data stream for at least a portion of the common field of view from the first and/or second sensor as a function of operating conditions at the roadway.

20 Claims, 18 Drawing Sheets

(56) References Cited

U.S. PATENT DOCUMENTS

| | | | | |
|---|---|---|---|---|
| 5,045,937 | A | 9/1991 | Myrick | |
| 5,221,956 | A | 6/1993 | Patterson et al. | |
| 5,239,296 | A | 8/1993 | Jenkins | |
| 5,245,909 | A | 9/1993 | Corrigan et al. | |
| 5,257,194 | A | 10/1993 | Sakita | |
| 5,293,455 | A | 3/1994 | Castelaz | |
| 5,438,361 | A | 8/1995 | Coleman | |
| 5,537,511 | A | 7/1996 | DeAngelis et al. | |
| 5,583,506 | A | 12/1996 | Sinor et al. | |
| 5,617,085 | A | 4/1997 | Tsutsumi et al. | |
| 5,633,946 | A | 5/1997 | Lachinski et al. | |
| 5,661,666 | A | 8/1997 | Pawlak | |
| 5,798,983 | A | 8/1998 | Kuhn et al. | |
| 5,801,943 | A | 9/1998 | Nasburg | |
| 5,850,625 | A | 12/1998 | Maren et al. | |
| 5,893,043 | A | 4/1999 | Moehlenbrink et al. | |
| 5,935,190 | A | 8/1999 | Davis et al. | |
| 5,952,957 | A | 9/1999 | Szu | |
| 5,963,653 | A | 10/1999 | McNary et al. | |
| 6,266,627 | B1 * | 7/2001 | Gatsonides | 702/143 |
| 6,499,025 | B1 | 12/2002 | Horvitz et al. | |
| 6,556,916 | B2 * | 4/2003 | Waite et al. | 701/117 |
| 6,574,548 | B2 * | 6/2003 | DeKock et al. | 701/117 |
| 6,580,497 | B1 | 6/2003 | Asaka et al. | |
| 6,670,905 | B1 | 12/2003 | Orr | |
| 6,670,912 | B2 | 12/2003 | Honda | |
| 6,693,557 | B2 * | 2/2004 | Arnold et al. | 340/933 |
| 6,696,978 | B2 | 2/2004 | Trajkovic et al. | |
| 6,738,697 | B2 | 5/2004 | Breed | |
| 6,771,208 | B2 | 8/2004 | Lutter et al. | |
| 6,903,676 | B1 | 6/2005 | Frady et al. | |
| 6,909,997 | B2 | 6/2005 | Chen et al. | |
| 6,933,883 | B2 | 8/2005 | Isaji | |
| 7,012,560 | B2 | 3/2006 | Braeuchle et al. | |
| 7,027,615 | B2 | 4/2006 | Chen | |
| 7,049,998 | B1 | 5/2006 | Frady et al. | |
| 7,099,796 | B2 | 8/2006 | Hamza | |
| 7,148,861 | B2 | 12/2006 | Yelton et al. | |
| 7,327,855 | B1 | 2/2008 | Chen | |
| 7,420,501 | B2 | 9/2008 | Perl | |
| 7,427,930 | B2 * | 9/2008 | Arnold et al. | 340/933 |
| 7,454,287 | B2 | 11/2008 | Manor | |
| 7,460,951 | B2 | 12/2008 | Altan et al. | |
| 7,474,259 | B2 * | 1/2009 | Manor | 342/174 |
| 7,532,152 | B1 | 5/2009 | Yonak | |
| 7,536,365 | B2 | 5/2009 | Aboutalib | |
| 7,541,943 | B2 | 6/2009 | Manor | |
| 7,558,536 | B2 | 7/2009 | Manor | |
| 7,558,762 | B2 | 7/2009 | Owechko et al. | |
| 7,573,400 | B2 | 8/2009 | Arnold et al. | |
| 7,576,681 | B2 | 8/2009 | Chen et al. | |
| 7,610,146 | B2 | 10/2009 | Breed | |
| 7,639,841 | B2 | 12/2009 | Zhu et al. | |
| 7,643,066 | B2 | 1/2010 | Henninger, III et al. | |
| 7,647,180 | B2 | 1/2010 | Breed | |
| 7,688,224 | B2 | 3/2010 | Teffer et al. | |
| 7,706,978 | B2 | 4/2010 | Schiffmann et al. | |
| 7,710,257 | B2 | 5/2010 | Miller | |
| 7,729,841 | B2 | 6/2010 | Knoop et al. | |
| 7,768,427 | B2 * | 8/2010 | Manor | 340/933 |
| 7,791,501 | B2 | 9/2010 | Ioli | |
| 7,796,081 | B2 | 9/2010 | Breed | |
| 7,889,098 | B1 * | 2/2011 | Arnold et al. | 340/907 |
| 7,991,542 | B2 * | 8/2011 | Giles et al. | 701/119 |
| 7,999,721 | B2 | 8/2011 | Orr | |
| 8,339,282 | B2 * | 12/2012 | Noble et al. | 340/937 |
| 2004/0135703 | A1 * | 7/2004 | Arnold et al. | 340/933 |
| 2006/0091654 | A1 | 5/2006 | DeMersseman et al. | |
| 2006/0125919 | A1 | 6/2006 | Camilleri et al. | |
| 2006/0202886 | A1 | 9/2006 | Mahapatra et al. | |
| 2007/0016359 | A1 | 1/2007 | Manor | |
| 2007/0030170 | A1 * | 2/2007 | Manor | 340/933 |
| 2007/0055446 | A1 | 3/2007 | Schiffmann et al. | |
| 2007/0247334 | A1 | 10/2007 | Gebert | |
| 2008/0040004 | A1 | 2/2008 | Breed | |
| 2008/0094250 | A1 * | 4/2008 | Myr | 340/909 |
| 2008/0129546 | A1 | 6/2008 | Manor | |
| 2008/0150762 | A1 | 6/2008 | Versavel | |
| 2008/0150786 | A1 | 6/2008 | Breed | |
| 2008/0167821 | A1 | 7/2008 | Breed | |
| 2008/0175438 | A1 | 7/2008 | Alves | |
| 2008/0285803 | A1 | 11/2008 | Madsen | |
| 2008/0300776 | A1 | 12/2008 | Petrisor et al. | |
| 2009/0030605 | A1 | 1/2009 | Breed | |
| 2009/0135050 | A1 | 5/2009 | Yonak | |
| 2009/0147238 | A1 | 6/2009 | Markov et al. | |
| 2009/0219172 | A1 | 9/2009 | Wilbrod | |
| 2009/0292468 | A1 | 11/2009 | Wu et al. | |
| 2009/0309785 | A1 * | 12/2009 | Nalezinski et al. | 342/200 |
| 2010/0164706 | A1 | 7/2010 | Jeng et al. | |
| 2010/0191391 | A1 | 7/2010 | Zeng | |
| 2010/0191461 | A1 | 7/2010 | Zeng | |
| 2010/0235129 | A1 | 9/2010 | Sharma et al. | |
| 2010/0253541 | A1 | 10/2010 | Seder et al. | |
| 2010/0253597 | A1 * | 10/2010 | Seder et al. | 345/7 |
| 2010/0256836 | A1 | 10/2010 | Mudalige | |
| 2010/0256852 | A1 | 10/2010 | Mudalige | |
| 2013/0069765 | A1 | 3/2013 | Noble et al. | |
| 2013/0151135 | A1 * | 6/2013 | Aubrey et al. | 701/118 |

FOREIGN PATENT DOCUMENTS

| | | | |
|---|---|---|---|
| EP | 0811855 | A2 | 12/1997 |
| JP | 2004205398 | A | 7/2004 |
| KR | 10-2002-0092046 | A | 12/2002 |
| KR | 10-2005-0075261 | A | 7/2005 |
| RU | 2251712 | C1 | 5/2005 |
| RU | 2381416 | C2 | 2/2010 |
| WO | WO2010/042483 | A1 | 4/2010 |

OTHER PUBLICATIONS

"Adaptive Lane Finding in Road Traffic Image Analysis" B.D. Stewart, I. Reading, M.S. Thomson, T.D. Binnie, K W. Dickinson, C.L. Wan, Napier University, Edinburgh, UK Road Traffic Monitoring and Control, Apr. 26-28, 1994 Conference Publication No. 391, IEE, 1994 pp. 133-136.

"Computer Vision Algorithms for Intersection Monitoring"; H. Veeraraghavan, O. Masoud, and N.P. Papanikolopoulous, IEEE Transactions on Intelligent Transportation Systems, vol. 4, No. 2, Jun. 2003, pp. 78-89.

Image Sensing Systems, Inc., "Simply Autoscope", 2007, 12 pages.

Jai, "Vehicle Imaging System (VIS")), from http://www.jai.com/EN/Traffic/Products/VehicleImagingSyste . . . , 2007, 2 pages.

Xtralis, "ASIM Dual-tech Detector DT 351", from http://xtralis.com/product_view.cfm?product_id=60, visited Oct. 11, 2010, 1 page.

RTE, "Volvo S60", from http:/www.rte.ie/motors/2010/0615/volvos60.html, visited Oct. 11, 2010, 2 pages.

Xtralis, "ASIM by Xtralis Traffic Detectors—DT 351 Microwave PIR Vehicle Detectors", 2 pages (date unknown).

"Red Light Hold Radar-based system prevents collisions from red light runners", Optisoft the Intelligent Traffic Signal Platform 2 pages (date unknown).

"Transportation Sensors Optional features for the OptiSoft ITS Platform", Optisoft The Intelligent Traffic Signal Platform 1 page (date unknown).

"Hidden Markov Model", from http://en.wikipedia.org/wiki/Hldden_markov_model, visited Feb. 22, 2011, 16 pages.

Search Report and Written Opinion from PCT Application Serial No. PCT/US2011/060726, dated Apr. 27, 2012, 9 pages.

* cited by examiner

150

180

HYBRID TRAFFIC SYSTEM AND ASSOCIATED METHOD

BACKGROUND

The present invention relates generally to traffic sensor systems and to methods of configuring and operating traffic sensor systems.

It is frequently desirable to monitor traffic on roadways and to enable intelligent transportation system controls. For instance, traffic monitoring allows for enhanced control of traffic signals, speed sensing, detection of incidents (e.g., vehicular accidents) and congestion, collection of vehicle count data, flow monitoring, and numerous other objectives.

Existing traffic detection systems are available in various forms, utilizing a variety of different sensors to gather traffic data. Inductive loop systems are known that utilize a sensor installed under pavement within a given roadway. However, those inductive loop sensors are relatively expensive to install, replace and repair because of the associated road work required to access sensors located under pavement, not to mention lane closures and traffic disruptions associated with such road work. Other types of sensors, such as machine vision and radar sensors are also used. These different types of sensors each have their own particular advantages and disadvantages.

It is desired to provide an alternative traffic sensing system. More particularly, it is desired to provide a traffic sensing system that allows for the use of multiple sensing modalities to be configured such that the strengths of one modality can help mitigate or overcome the weaknesses of the other.

SUMMARY

In one aspect, a traffic sensing system for sensing traffic at a roadway according to the present invention includes a first sensor having a first field of view, a second sensor having a second field of view, and a controller. The first and second fields of view at least partially overlap in a common field of view over a portion of the roadway, and the first sensor and the second sensor provide different sensing modalities. The controller is configured to select a sensor data stream for at least a portion of the common field of view from the first and/or second sensor as a function of operating conditions at the roadway.

In another aspect, a method of normalizing overlapping fields of view of a traffic sensor system for sensing traffic at a roadway according to the present invention includes positioning a first synthetic target generator device on or near the roadway, sensing roadway data with a first sensor having a first sensor coordinate system, sensing roadway data with a second sensor having a second sensor coordinate system, detecting a location of the first synthetic target generator device in the first sensor coordinate system with the first sensor, displaying sensor output of the second sensor, selecting a location of the first synthetic target generator device on the display in the second sensor coordinate system, and correlating the first and second coordinate systems as a function of the locations of the first synthetic target generator device in the first and second sensor coordinate systems. The sensed roadway data of the first and second sensors overlap in a first roadway area, and the first synthetic target generator is positioned in the first roadway area.

Other aspects of the present invention will be appreciated in view of the detailed description that follows.

Figure 1:
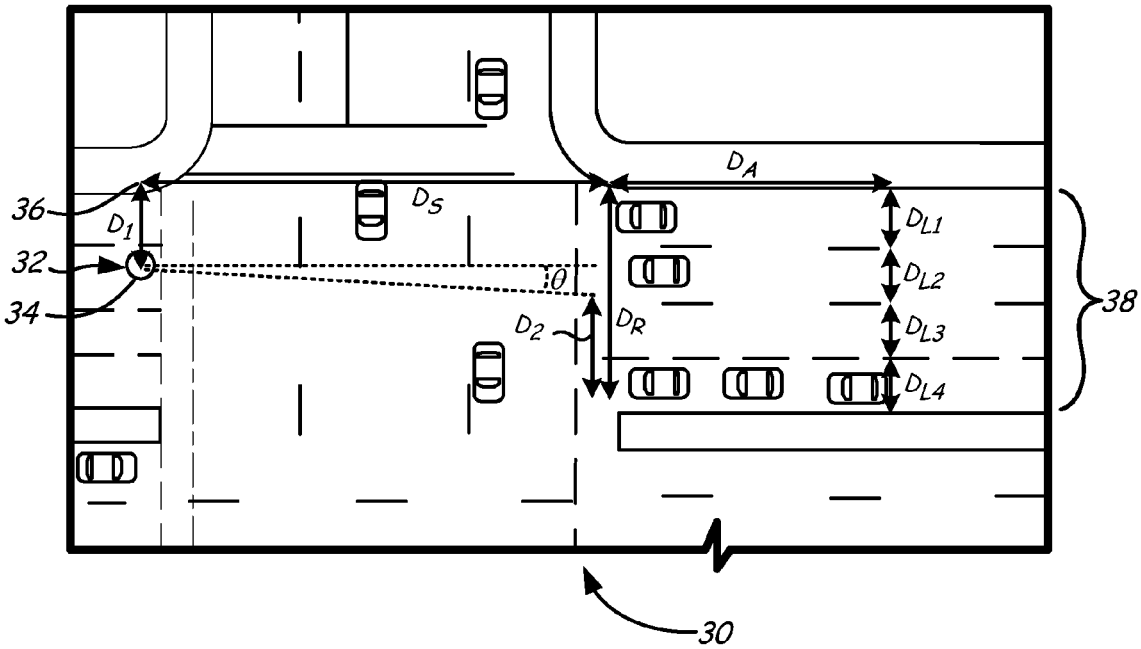
FIG. 1 is plan view of an example roadway intersection at which a traffic sensing system is installed.

While the above-identified drawing figures set forth embodiments of the invention, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale, and applications and embodiments of the present invention may include features and components not specifically shown in the drawings.

DETAILED DESCRIPTION

In general, the present invention provides a traffic sensing system that includes multiple sensing modalities, as well as an associated method for normalizing overlapping sensor fields of view and operating the traffic sensing system. The system can be installed at a roadway, such as at a roadway intersection, and can work in conjunction with traffic control systems. Traffic sensing systems can incorporate radar sensors, machine vision sensors, etc. The present invention provides a hybrid sensing system that includes different types of sensing modalities (i.e., different sensor types) with at least partially overlapping fields of view that can each be selectively used for traffic sensing under particular circumstances. These different sensing modalities can be switched as a function of operating conditions. For instance, machine vision sensing can be used during clear daytime conditions and radar sensing can be used instead during nighttime conditions. In various embodiments, switching can be implemented across an entire field of view for given sensors, or can alternatively be implemented for one or more subsections of a given sensor field of view (e.g., to provide switching for one or more discrete detector zones established within a field of view). Such a sensor switching approach is generally distinguishable from data fusion. Alternatively, different sensing modalities can work simultaneously or in conjunction as desired for certain circumstances. The use of multiple sensors in a given traffic sensing system presents numerous challenges, such as the need to correlate sensed data from the various sensors such that detections with any sensing modality are consistent with respect to real-world objects and locations in the spatial domain. Furthermore, sensor switching requires appropriate algorithms or rules to guide the appropriate sensor selection as a function of given operating conditions. In operation, traffic sensing allows for the detection of objects in a given field of view, which allows for traffic signal control, data collection, warnings, and other useful work. This application claims priority to U.S. Provisional Patent Application Ser. No. 61/413,764, entitled "Autoscope Hybrid Detection System," filed Nov. 15, 2010, which is hereby incorporated by reference in its entirety.

FIG. 1 is plan view of an example roadway intersection 30 (e.g., signal-controlled intersection) at which a traffic sensing system 32 is installed. The traffic sensing system 32 includes a hybrid sensor assembly (or field sensor assembly) 34 supported by a support structure 36 (e.g., mast arm, luminaire, pole, or other suitable structure) in a forward-looking arrangement. In the illustrated embodiment, the sensor assembly 34 is mounted in a middle portion of a mast arm that extends across at least a portion of the roadway, and is arranged in an opposing direction (i.e., opposed relative to a portion of the roadway of interest for traffic sensing). The sensor assembly 34 is located a distance $D_1$ from an edge of the roadway (e.g., from a curb) and at a height H above the roadway (e.g., about 5-11 m). The sensor assembly 34 has an azimuth angle θ with respect to the roadway, and an elevation (or tilt) angle β. The azimuth angle θ and the elevation (or tilt) angle β can be measured with respect to a center of a beam or field of view (FOV) of each sensor of the sensor assembly 34. In relation to features of the roadway intersection 30, the sensor assembly 34 is located a distance $D_S$ from a stop bar (synonymously called a stop line) for a direction of approach of traffic 38 intended to be sensed. A stop bar is generally a designated (e.g., painted line) or de facto (i.e., not indicated on the pavement) location where traffic stops in the direction of approach 38 of the roadway intersection 30. The direction of approach 38 has a width $D_R$ and 1 to n lanes of traffic, which in the illustrated embodiment includes four lanes of traffic having widths $D_{L1}$, $D_{L2}$, $D_{L3}$ and $D_{L4}$ respectively. An area of interest in the direction of approach of traffic 38 has a depth $D_A$, measured beyond the stop bar in relation to the sensor assembly 34.

It should be noted that while FIG. 1 specifically identifies elements of the intersection 30 and the traffic sensing system 32 for a single direction of approach, a typical application will involve multiple sensor assemblies 34, with at least one sensor assembly 34 for each direction of approach for which it is desired to sense traffic data. For example, in a conventional four-way intersection, four sensor assemblies 34 can be provided. At a T-shaped, three-way intersection, three sensor assemblies 34 can be provided. The precise number of sensor assemblies 34 can vary as desired, and will frequently be influenced by roadway configuration and desired traffic sensing objectives. Moreover, the present invention is useful for applications other than strictly intersections. Other suitable applications include use at tunnels, bridges, toll stations, access-controlled facilities, highways, etc.

The hybrid sensor assembly 34 can include a plurality of discrete sensors, which can provide different sensing modalities. The number of discrete sensors can vary as desired for particular applications, as can the modalities of each of the sensors. Machine vision, radar (e.g., Doppler radar), LIDAR, acoustic, and other suitable types of sensors can be used.

Figure 2:
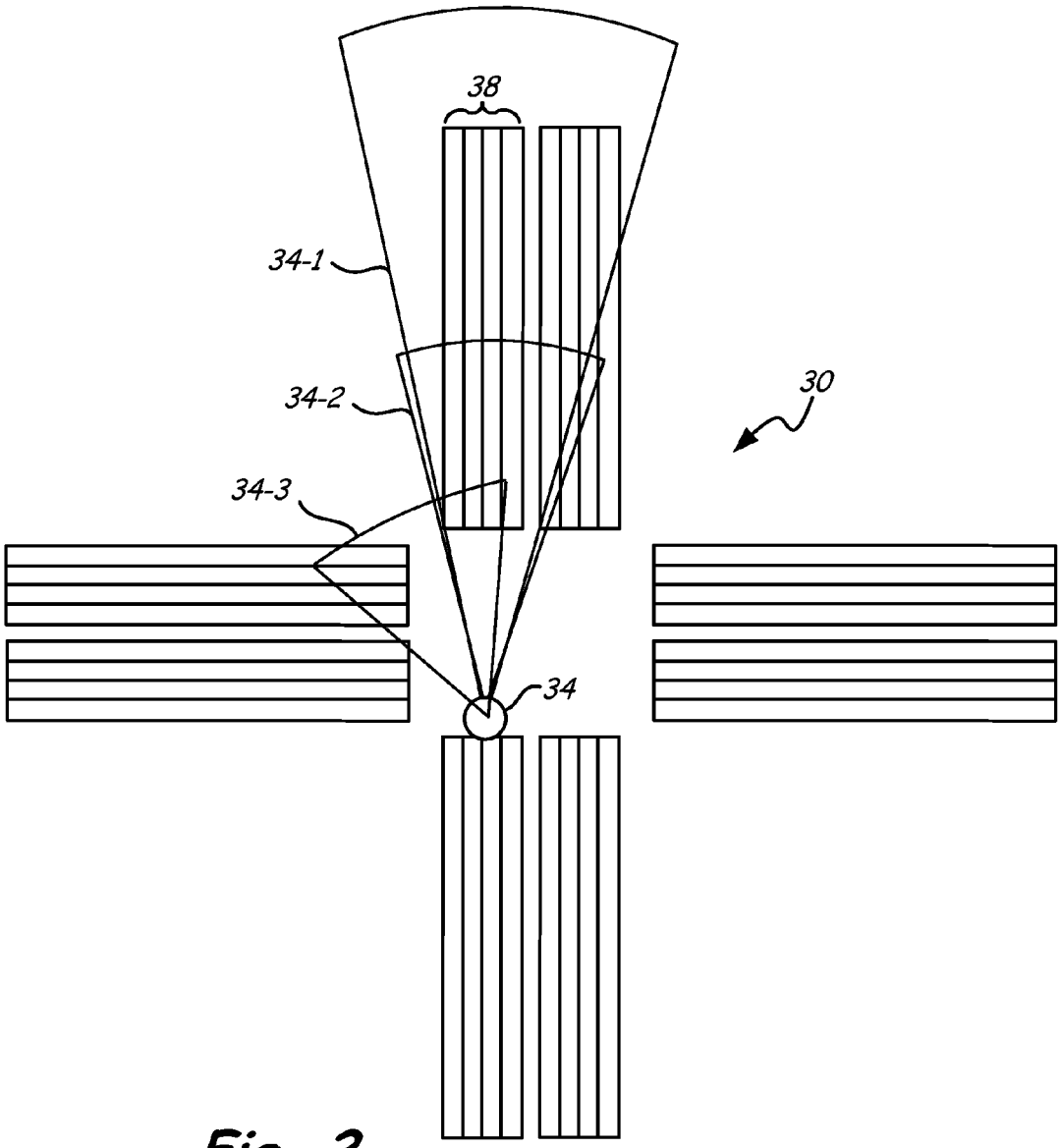
FIG. 2 is a schematic view of the roadway intersection illustrating one embodiment of overlapping fields of view for multiple sensors.

FIG. 2 is a schematic view of the roadway intersection 30 illustrating one embodiment of three overlapping fields of view 34-1, 34-2 and 34-3 for respective discrete sensors of the hybrid sensor assembly 34. In the illustrated embodiment, the first field of view 34-1 is relatively large and has an azimuth angle $\theta_1$ close to zero, the second field of view 34-2 is shorter (i.e., shallower depth of field) and wider than the first field of view 34-1 but also has an azimuth angle $\theta_2$ close to zero, while the third field of view 34-3 is shorter and wider than the second field of view 34-2 but has an azimuth angle with an absolute value significantly greater than zero. In this way, the first and second fields of view 34-1 and 34-2 have a substantial overlap, while the third field of view 34-3 provides less overlap and instead encompasses additional roadway area (e.g., turning regions). It should be noted that fields of view 34-1, 34-2 and 34-3 can vary based on an associated type of sensing modality for a corresponding sensor. Moreover, the number and orientation of the fields of view 34-1, 34-2 and 34-3 can vary as desired for particular applications. For instance, in one embodiment, only the first and second fields of view 34-1 and 34-2 can be provided, and the third field of view 34-3 omitted.

Figure 3:
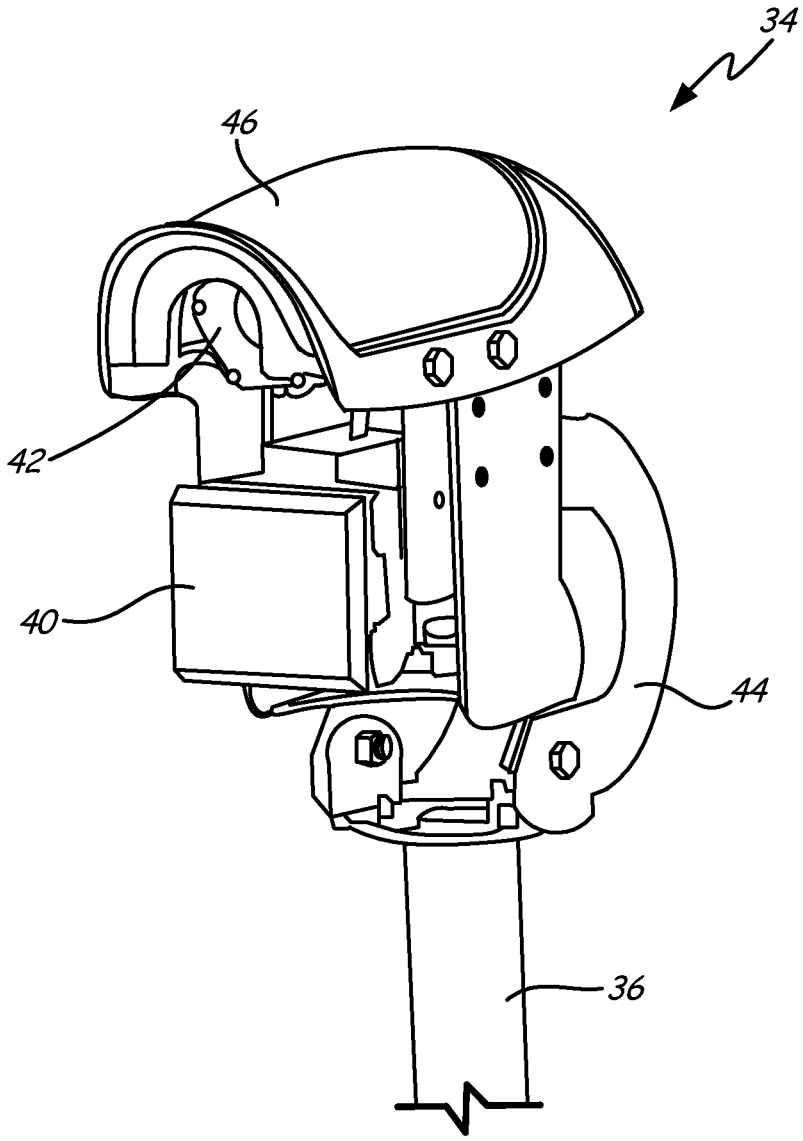
FIG. 3 is a perspective view of an embodiment of a hybrid sensor assembly of the traffic sensing system.

FIG. 3 is a perspective view of an embodiment of the hybrid sensor assembly 34 of the traffic sensing system 32. A first sensor 40 can be a radar (e.g., Doppler radar), and a second sensor 42 can be a machine vision device (e.g., charge-coupled device). The first sensor 40 can be located below the second sensor, with both sensors 40 and 42 generally facing the same direction. The hardware should have a robust mechanical design that meets National Electrical Manufacturers Association (NEMA) environmental requirements. In one embodiment, the first sensor 40 can be an Universal Medium Range Resolution (UMRR) radar, and the second sensor 42 can be a visible light camera which is capable of recording images in a video stream composed of a series of image frames. A support mechanism 44 commonly supports the first and second sensors 40 and 42 on the support structure 36, while allowing for sensor adjustment (e.g., adjustment of pan/yaw, tilt/elevation, etc.). Adjustment of the support mechanism allows for simultaneous adjustment of the position of both the first and second sensors 40 and 42. Such simultaneous adjustment facilitates installation and set-up where the azimuth angles $\theta_1$ and $\theta_2$ of the first and second sensors 40 and 42 are substantially the same. For instance, where the first sensor 40 is a radar, the orientation of the field of view of the second sensor 42 simply through manual sighting along a protective covering 46 can be used to simplify aiming of the radar due to mechanical relationships between the sensors. In some embodiments, the first and the second sensors 40 and 42 can also permit adjustment relative to one another (e.g., rotation, etc.). Independent sensor adjustment may be desirable where the azimuth angles $\theta_1$ and $\theta_2$ of the first and second sensors 40 and 42 are desired to be significantly different. The protective covering 46 can be provided to help protect and shield the first and second sensors 40 and 42 from environmental conditions, such as sun, rain, snow and ice. Tilt of the first sensor 40 can be constrained to a given range to minimize protrusion from a lower back shroud and field of view obstruction by other portions of the assembly 34.

Figure 4A:
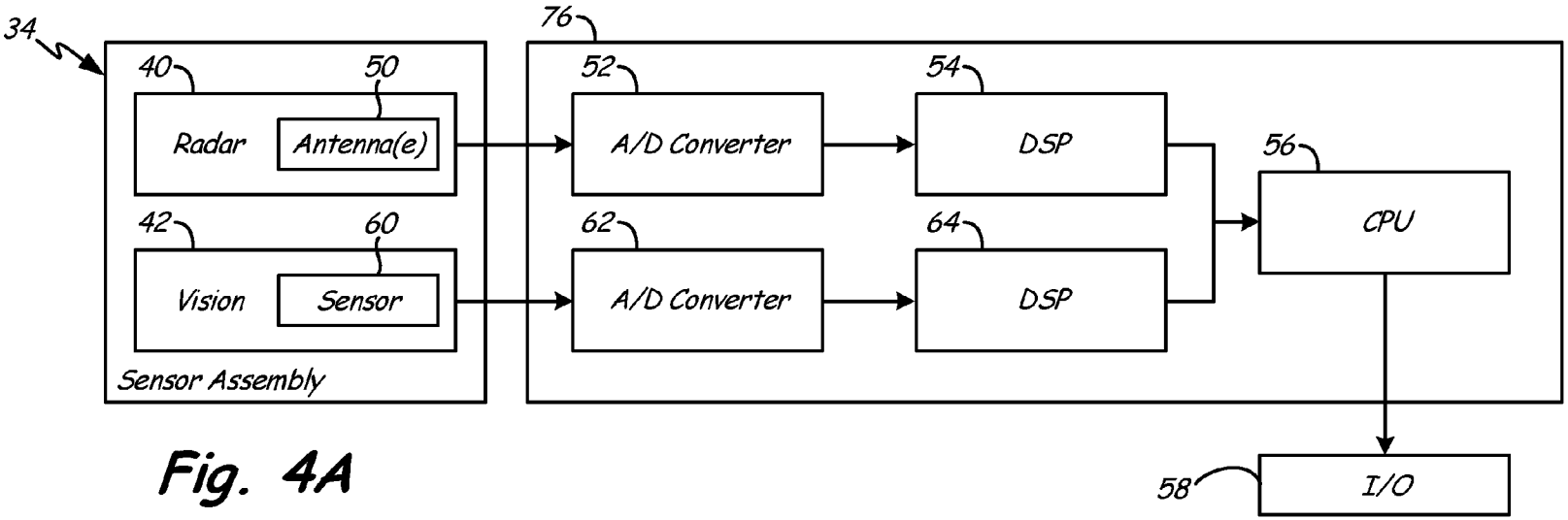
FIG. 4A is a schematic block diagram of one embodiment of a hybrid sensor assembly and associated circuitry.

FIG. 4A is a schematic block diagram of an embodiment of the hybrid sensor assembly 34 and associated circuitry. In the illustrated embodiment, the first sensor 40 is a radar (e.g., Doppler radar) and includes one or more antennae 50, and analog-to-digital (A/D) converter 52, and a digital signal processor (DSP) 54. Output from the antenna(e) 50 is sent to the A/D converter 52, which sends a digital signal to the DSP 54. The DSP 54 communicates with a processor (CPU) 56, which is connected to an input/output (I/O) mechanism 58 to allow the first sensor 40 to communicate with external components. The I/O mechanism can be a port for a hard-wired connection, and alternatively (or in addition) can provide for wireless communication.

Furthermore, in the illustrated embodiment, the second sensor 42 is a machine vision device and includes a vision sensor (e.g., CCD or CMOS array) 60, an A/D converter 62, and a DSP 64. Output from the vision sensor 60 is sent to the A/D converter 62, which sends a digital signal to the DSP 64. The DSP 64 communicates with the processor (CPU) 56, which in turn is connected to the I/O mechanism 58.

Figure 4B:
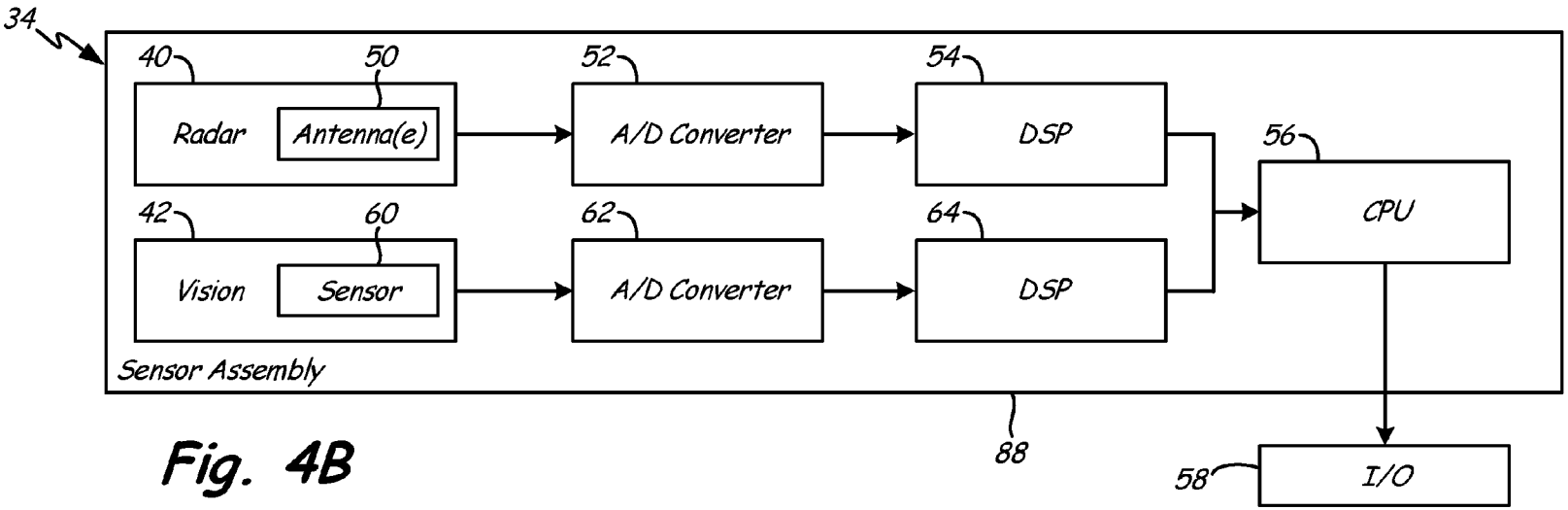
FIG. 4B is a schematic block diagram of another embodiment of a hybrid sensor assembly.

FIG. 4B is a schematic block diagram of another embodiment of a hybrid sensor assembly 34. As shown in FIG. 4B, the A/D converters 52 and 62, DSPs 54 and 64, and CPU 56 are all integrated into the same physical unit as the sensors 40 and 42, in contrast to the embodiment of FIG. 4A where the A/D converters 52 and 62, DSPs 54 and 64, and CPU 56 can be located remote from the hybrid sensor assembly 34 in a separate enclosure.

Internal sensor algorithms can be the same or similar to those for known traffic sensors, with any desired modifications of additions, such as queue detection and turning movement detection algorithms that can be implemented with a hybrid detection module (HDM) described further below.

It should be noted that the embodiment illustrated in FIG. 4 is shown merely by way of example, and not limitation. In further embodiments, other types of sensors can be utilized, such as LIDAR, etc. Moreover, more than two sensors can be used, as desired for particular applications.

Figure 5A:
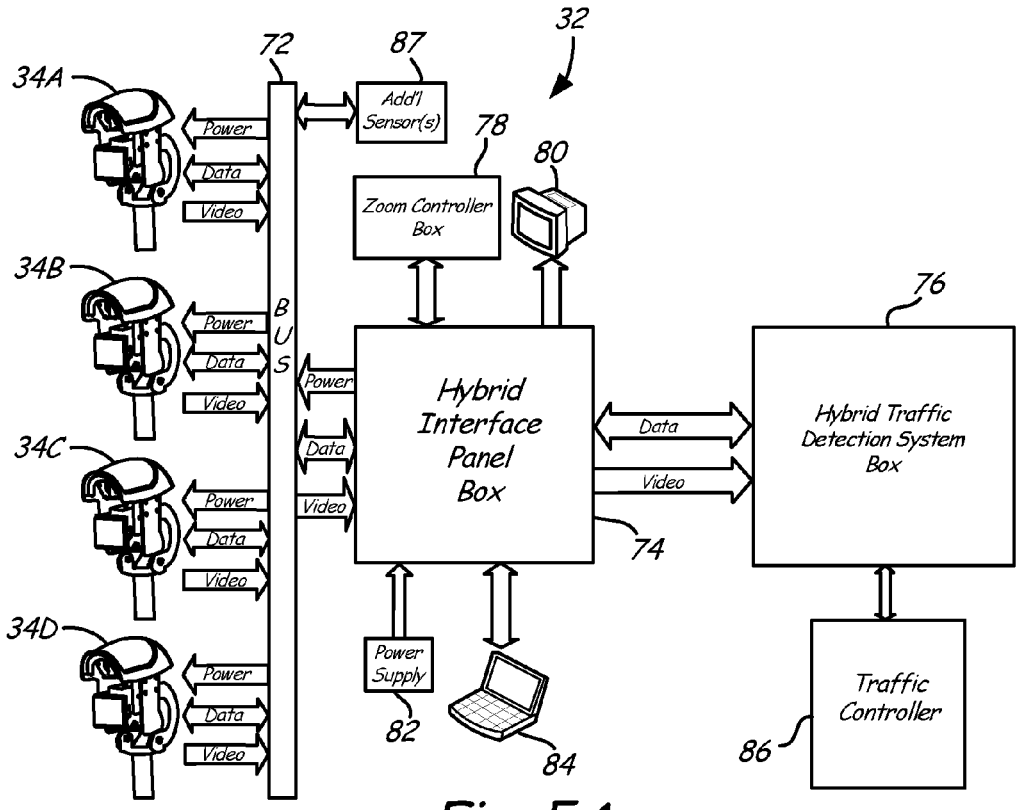
FIG. 5A is a schematic block diagram of one embodiment of the traffic sensing system, having separate system boxes.

In a typical installation, the hybrid sensor assembly 34 is operatively connected to additional components, such as one or more controller or interfaces boxes and a traffic controller (e.g., traffic signal system). FIG. 5A is a schematic block diagram of one embodiment of the traffic sensing system 32, which includes four hybrid sensor assemblies 34A-34D, a bus 72, a hybrid interface panel box 74, and a hybrid traffic detection system box 76. The bus 72 is operatively connected to each of the hybrid sensor assemblies 34A-34D, and allows transmission of power, video and data. Also connected to the bus 72 is the hybrid interface panel box 74. A zoom controller box 78 and a display 80 are connected to the hybrid interface panel box 74 in the illustrated embodiment. The zoom controller box 78 allows for control of zoom of machine vision sensors of the hybrid sensor assemblies 34A-34D. The display 80 allows for viewing of video output (e.g., analog video output). A power supply 82 is further connected to the hybrid interface panel box 74, and a terminal 84 (e.g., laptop computer) can be interfaced with the hybrid interface panel box 74. The hybrid interface panel box 74 can accept 110/220 VAC power and provides 24 VDC power to the sensor assemblies 34A-34D. Key functions of the hybrid interface panel box 74 are to deliver power to the hybrid sensor assemblies 34A-34D and to manage communications between the hybrid sensor assemblies 34A-34D and other components like the hybrid traffic detection system box 76. The hybrid interface panel box 74 can include suitable circuitry, processors, computer-readable memory, etc. to accomplish those tasks and to run applicable software. The terminal 84 allows an operator or technician to access and interface with the hybrid interface panel box 74 and the hybrid sensor assemblies 34A-34D to perform set-up, configuration, adjustment, maintenance, monitoring and other similar tasks. A suitable operating system, such as WINDOWS from Microsoft Corporation, Redmond, Wash., can be used with the terminal 84. The terminal 84 can be located at the roadway intersection 30, or can be located remotely from the roadway 30 and connected to the hybrid interface panel box 74 by a suitable connection, such as via Ethernet, a private network or other suitable communication link. The hybrid traffic detection system box 76 in the illustrated embodiment is further connected to a traffic controller 86, such as a traffic signal system that can be used to control traffic at the intersection 30. The hybrid detection system box 76 can include suitable circuitry, processors, computer-readable memory, etc. to run applicable software, which is discussed further below. In some embodiments, the hybrid detection system box 76 includes one or more hot-swappable circuitry cards, with each card providing processing support for a given one of the hybrid sensor assemblies 34A-34D. In further embodiments, the traffic controller 86 can be omitted. One or more additional sensors 87 can optionally be provided, such as a rain/humidity sensor, or can be omitted in other embodiments. It should be noted that the illustrated embodiment of FIG. 5A is shown merely by way of example. Alternative implementations are possible, such as with further bus integration or with additional components not specifically shown. For example, an Internet connection that enables access to third-party data, such as weather information, etc., can be provided.

Figure 5B:
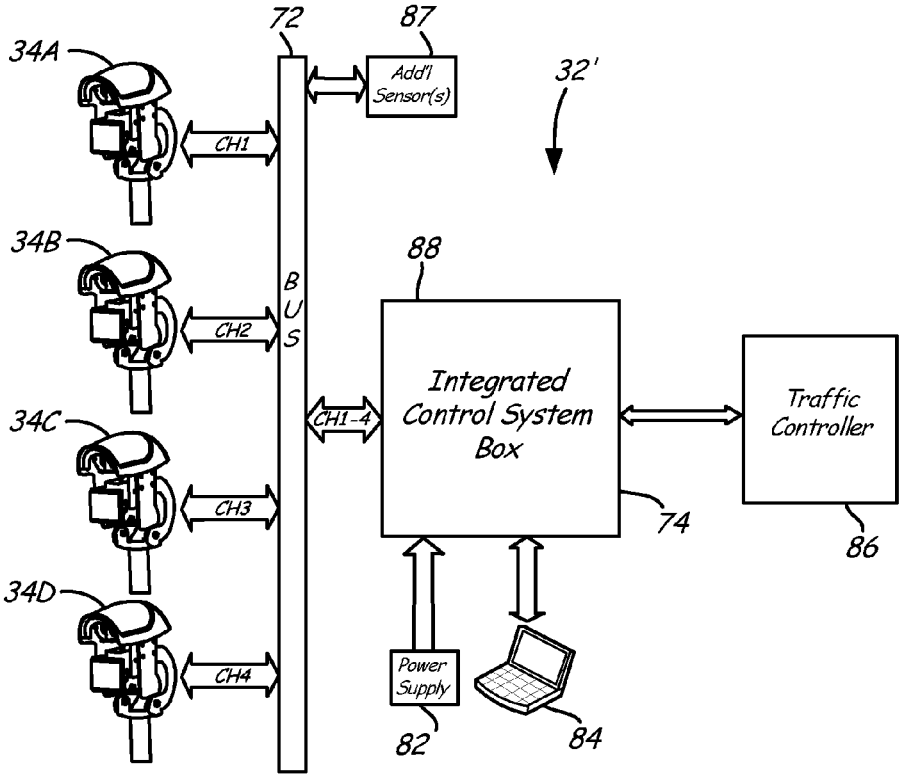
FIG. 5B is a schematic block diagram of another embodiment of the traffic sensing system, having a single integrated system box.

FIG. 5B is a schematic block diagram of another embodiment of the traffic sensing system 32'. The embodiment of system 32' shown in FIG. 5B is generally similar to that of system 32 shown in FIG. 5A; however, the system 32' includes an integrated control system box 88 that provides functions of both the hybrid interface panel box 74 and the hybrid traffic detection system box 76. The integrated control system box 88 can be located at or in close proximity to the hybrid sensors 34, with only minimal interface circuitry on the ground to plumb detection signals to the traffic controller 86. Integrating multiple control boxes together can facilitate installation.

Figure 6:
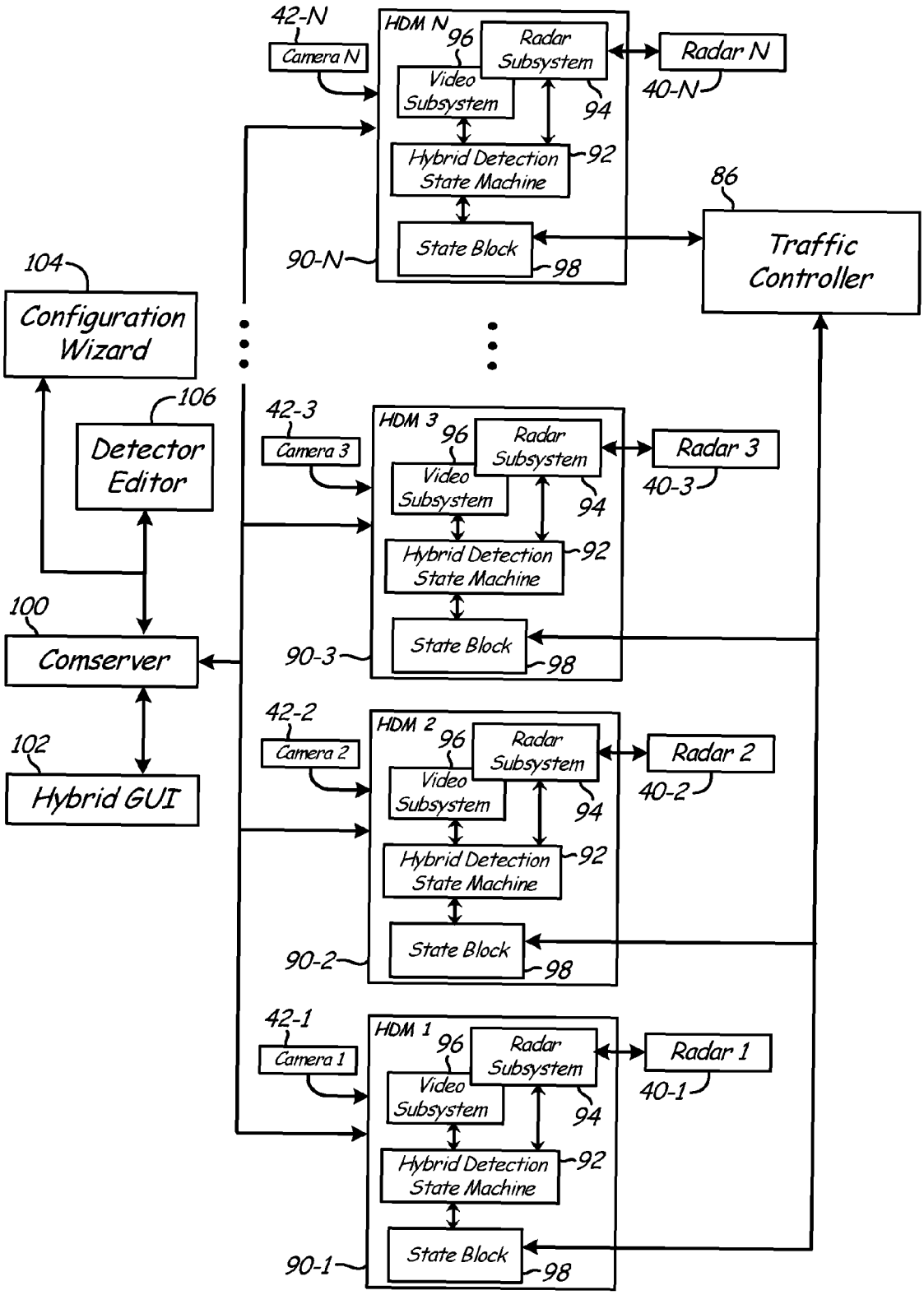
FIG. 6 is a schematic block diagram of software subsystems of the traffic sensing system.

FIG. 6 is a schematic block diagram of software subsystems of the traffic sensing system 32 or 32'. For each n hybrid sensor assemblies, a hybrid detection module (HDM) 90-1 to **90-*n* is provided that includes a hybrid detection state machine (HDSM) 92, a radar subsystem 94, a video subsystem 96 and a state block 98. In general, each HDM 90-1 to 90-*n* correlates, synchronizes and evaluates the detection results from the first and second sensors 40 and 42, but also contains decision logic to discern what is happening in the scene (e.g., intersection 30) when the two sensors 40 and 42 (and subsystems 94 and 96) offer conflicting assessments. With the exception of certain Master-Slave functionality, each HDM 90-1 to 90-*n* generally operates independently of the others, thereby providing a scalable, modular system. The hybrid detection state machine 92 of the HDMs 90-1 to 90-*n* further can combine detection outputs from the radar and video subsystems 94 and 96 together. The HDMs 90-1 to 90-*n* can add data from the radar subsystem 94 onto a video overlay from the video subsystem 96, which can be digitally streamed to the terminal 84 or displayed on the display 80 in analog for viewing. While the illustrated embodiment is described with respect to radar and video/camera (machine vision) sensors, it should be understood that other types of sensors can be utilized in alternative embodiments. The software of the system 32 or 32' further includes a communication server (comserver) 100 that manages communication between each of the HDMs 90-1 to 90-*n* and a hybrid graphical user interface (GUI) 102, a configuration wizard 104 and a detector editor 106. HDM 90-1 to 90-*n* software can run independent of GUI 102 software once configured, and incorporates communication from the GUI 102, the radar subsystem 94, the video subsystem 96 as well as the HDSM 92. HDM 90-1 to 90-*n* software can be implemented on respective hardware cards provided in the hybrid traffic detection system box 76 of the system 32 or the integrated control system box 88 of the system 32'**.

The radar and video subsystems 94 and 96 process and control the collection of sensor data, and transmit outputs to the HDSM 92. The video subsystem 96 (utilizing appropriate processor(s) or other hardware) can analyze video or other image data to provide a set of detector outputs, according to the user's detector configuration created using the detector editor 106 and saved as a detector file. This detector file is then executed to process the input video and generate output data which is then transferred to the associated HDM 90-1 to **90-*n* for processing and final detection selection. Some detectors, such as queue size detector and detection of turning movements, may require additional sensor information (e.g., radar data) and thus can be implemented in the HDM 90-1 to 90-*n*** where such additional data is available.

The radar subsystem 94 can provide data to the associated HDMs 90-1 to **90-*n* in the form of object lists, which provide speed, position, and size of all objects (vehicles, pedestrians, etc.) sensed/tracked. Typically, the radar has no ability to configure and run machine vision-style detectors, so the detector logic must generally be implemented in the HDMs 90-1 to 90-*n*. Radar-based detector logic in the HDMs 90-1 to 90-*n* can normalize sensed/tracked objects to the same spatial coordinate system as other sensors, such as machine vision devices. The system 32 or 32'** can use the normalized object data, along with detector boundaries obtained from a machine vision (or other) detector file to generate detector outputs analogous to what a machine vision system provides.

The state block 98 provides indication and output relative to the state of the traffic controller 86, such as to indicate if a given traffic signal is "green", "red", etc.

The hybrid GUI 102 allows an operator to interact with the system 32 or 32', and provides a computer interface, such as for sensor normalization, detection domain setting, and data streaming and collection to enable performance visualization and evaluation. The configuration wizard 104 can include features for initial set-up of the system and related functions. The detector editor 106 allows for configuration of detection zones and related detection management functions. The GUI 102, configuration wizard 104 and detector editor 106 can be accessible via the terminal 84 or a similar computer operatively connected to the system 32. It should be noted that while various software modules and components have been described separately, it should be noted that these functions can be integrated into a single program or software suite, or provided as separate stand-alone packages. The disclosed functions can be implemented via any suitable software in further embodiments.

The GUI 102 software can run on a Windows® PC, Apple PC or Linux PC, or other suitable computing device with a suitable operating system, and can utilize Ethernet or other suitable communication protocols to communicate with the HDMs 90-1 to **90-*n*. The GUI 102 provides a mechanism for setting up the HDMs 90-1 to 90-*n*, including the video and the radar subsystems 94 and 96 to: (1) normalize/align fields of view from both the first and second sensors 40 and 42; (2) configure parameters for the HDSM 92 to combine video and radar data; (3) enable visual evaluation of detection performance (overlay on video display); and (4) allow collection of data, both standard detection output and development data. A hybrid video player of the GUI 102 will allow users to overlay radar-tracking markers (or markers from any other sensing modality) onto video from a machine vision sensor (see FIGS. 11B and 14). These tracking markers can show regions where the radar is currently detecting vehicles. This video overlay is useful to verify that the radar is properly configured, as well as to enable users to easily evaluate the radar's performance in real-time. The hybrid video player of the GUI 102** can allow a user to select from multiple display modes, such as: (1) Hybrid—shows current state of the detectors determined from hybrid decision logic using both the machine vision and radar sensor inputs; (2) Video/Vision—shows current state of the detectors using only machine vision input; (3) Radar—shows current state of the detectors using only radar sensor input; and/or (4) Video/Radar Comparison—provides a simple way to visually compare the performance of machine vision and radar, using a multi-color scheme (e.g., black, blue, red and green) to show all of the permutations of when the two devices agree and disagree for a given detection zone. In some embodiments, only some of the display modes described above can be made available to users.

The GUI 102 communicates with the HDMs 90-1 to **90-*n* via an API, namely additions to a client application programming interface (CLAPI), which can go through the comserver 100, and eventually to the HDMs 90-1 to 90-*n*. An applicable communications protocol can send and receive normalization information, detector output definitions, configuration data, and other information to support the GUI 102**.

Functionality for interpreting, analyzing and making final detections or other such functions of the system are primarily performed by the hybrid detection state machine 92. The HDSM 92 can take outputs from detectors, such as machine vision detectors and radar-based detectors, and arbitrates between them to make final detection decisions. For radar data, the HDSM 92 can, for instance, retrieve speed, size and polar coordinates of target objects (e.g., vehicles) as well as Cartesian coordinates of tracked objects, from the radar subsystem 94 and the corresponding radar sensors 40-1 to **40-*n*. For machine vision, the HDSM 92 can retrieve data from the detection state block 98 and from the video subsystem 96 and the associated video sensors (e.g., camera) 42-1 to 42-*n*. Video data is available at the end of every video frame processed. The HDSM 92** can contain and perform sensor algorithm data switching/fusion/decision logic/etc. to process radar and machine vision data. A state machine to determine which detection outcomes can be used, based on input from the radar and machine vision data and post-algorithm decision logic. Priority can be given to the sensor believed to be most accurate for the current conditions (time of day, weather, video contrast level, traffic level, sensor mounting position, etc.).

The state block 98 can provide final, unified detector outputs to a bus or directly to the traffic controller 86 through suitable ports (or wirelessly). Polling at regular intervals can be used to provide these detector outputs from the state block 98. Also, the state block can provide indications of each signal phase (e.g., red, green) of the signal controller 86 as an input.

Numerous types of detection can be employed. Presence or stop-line detectors identify the presence of a vehicle in the field of view (e.g., at the stop line or stop bar); their high accuracy in determining the presence of vehicles makes them ideal for signal-controlled intersection applications. Count and speed detection (which includes vehicle length and classification) for vehicles passing along the roadway. Crosslane count detectors provide the capability to detect the gaps between vehicles, to aid in accurate counting. The count detectors and speed detectors work in tandem to perform vehicle detection processing (that is, the detectors show whether or not there is a vehicle under the detector and calculate its speed). Secondary detector stations compile traffic volume statistics. Volume is the sum of the vehicles detected during a time interval specified. Vehicle speeds can be reported either in km/hr or mi/hr. and can be reported as an integer. Vehicle lengths can be reported in meters or feet. Advanced detection can be provided for the dilemma zone (primarily focusing on presence detection, speed, acceleration and deceleration). The "dilemma zone" is the zone in which drivers must decide to proceed or stop as the traffic control (i.e., traffic signal light) changes from green to amber and then red. Turning movement counts can be provided, with secondary detector stations connected to primary detectors to compile traffic volume statistics. Volume is the sum of the vehicles detected during a time interval specified. Turning movement counts are simply counts of vehicles making turns at the intersection (not proceeding straight through the intersection). Specifically, left turning counts and right turning counts can be provided separately. Often, traffic in the same lane may either proceed straight through or turn and this dual lane capability must be taken into account. Queue size measurement can also be provided. The queue size can be defined as the objects stopped or moving below a user-defined speed (e.g., a default 5 ml/hr threshold) at the intersection approach; thus, the queue size can be the number of vehicles in the queue. Alternately, the queue size can be measured from the stop bar to the end of the upstream queue or end of the furthest detection zone, whichever is shortest. Vehicles can be detected as they approach and enter the queue, with continuous accounting of the number of vehicles in the region defined by the stop line extending to the back of the queue tail.

Handling of errors is also provided, including handling of communication, software errors and hardware errors. Regarding potential communication errors, outputs can be set to place a call to fail safe in the following conditions: (i) for failure of communications between hardware circuitry and the associated radar sensors (e.g., first sensors 40) and only outputs associated with that radar sensor, the machine vision outputs (e.g., second sensors 42) can be used instead, if operating properly; (ii) for loss of a machine vision output and only outputs associated with that machine vision sensor; and (iii) for loss of detector port communications—associated outputs will be placed into call or fail safe for the slave unit whose communications is lost. A call is generally an output (e.g., to the traffic controller 86) based on a detection (i.e., a given detector triggered "on"), and a fail-safe call can default to a state that corresponds to a detection, which generally reduces the likelihood of a driver being "stranded" at an intersection because of a lack of detection. Regarding potential software errors, outputs can be set to place call to fail safe if the HDM software 90-1 to **90-*n* is not operational. Regarding potential hardware errors, selected outputs can be set to place call (sink current), or fail safe, in the following conditions: (i) loss of power, all outputs; (ii) failure of control circuitry, all outputs; and (iii) failure of any sensors of the sensor assemblies 34A-34**D, only outputs associated with failed sensors.

Although the makeup of software for the traffic sensing system 32 or 32' has been described above, it should be understood that various other features not specifically discussed can be incorporated as desired for particular applications. For example, known features of the Autoscope® system and RTMS® system, both available from Image Sensing Systems, Inc., St. Paul, Minn., can be incorporated. For instance, such known functionality can include: (a) a health monitor—monitors the system to ensure everything is running properly; (b) a logging system—logs all significant events for troubleshooting and servicing; (c) detector port messages—for use when attaching a device (slave) for communication with another device (master); detector processing of algorithms—for processing the video images and radar outputs to enable detection and data collection; (d) video streaming—for allowing the user to see an output video feed; (e) writing to non-volatile memory—allows a module to write and read internal non-volatile memory containing a boot loader, operational software, plus additional memory that system devices can write to for data storage; (f) protocol messaging—message/protocol from outside systems to enable communication with the traffic sensing system 32 or 32'; (g) a state block—contains the state of the I/O; and (h) data collection—for recording I/O, traffic data, and alarm states.

Now that basic components of the traffic sensing system 32 and 32' have been described, a method of installing and normalizing the system can be discussed. Normalization of overlapping sensor fields of view of a hybrid system is important so that data obtained from different sensors, especially those using different sensing modalities, can be correlated and used in conjunction or interchangeably. Without suitable normalization, use of data from different sensors would produce detections in disparate coordinate systems preventing a unified system detection capability.

Figure 7:
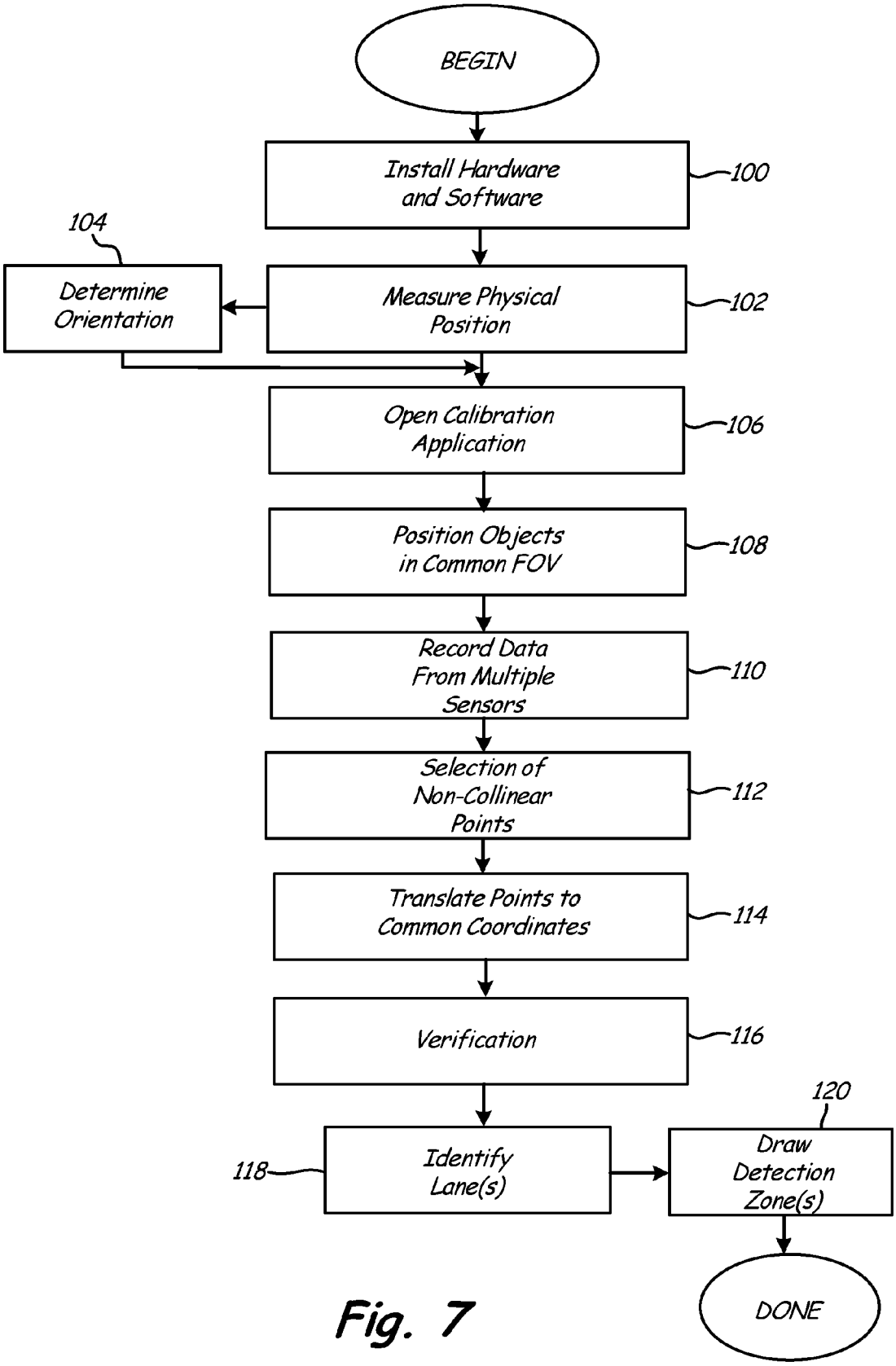
FIG. 7 is a flow chart illustrating an installation and normalization method according to the present invention.

FIG. 7 is a flow chart illustrating an installation and normalization method for use with the system 32 and 32'. Initially, hardware and associated software are installed at location where traffic sensing is desired, such as the roadway intersection 30 (step 100). Installation includes physically installing all sensor assemblies 34 (the number of assemblies provided will vary for particular applications), installing control boxes 74, 76 and/or 88, making wired and/or wireless connections between components, and aiming the sensor assemblies 34 to provide desired fields of view (see FIGS. 2 and 8). The sensor assemblies 34 can be mounted to any suitable support structure 36, and the particular mounting configuration will vary as desired for particular applications. Aiming the sensor assemblies 34 an include pan/yaw (left or right), elevation/tilt (up or down), camera barrel rotation (clockwise or counterclockwise), sunshield/covering overhang, and zoom adjustments. Once physically installed, relevant physical positions can be measured (step 102). Physical measurements can be taken manually by a technician, such as height H of the sensor assemblies 34, and distances $D_1$, $D_S$, $D_A$, $D_R$, $D_{L1}$ to $D_{L2}$, described above with respect to FIG. 1. These measurements can be used to determine sensor orientation, help normalize and calibrate the system and establish sensing and detection parameters. In one embodiment, only sensor height H and distance to the stop bar $D_S$ measurements are taken.

After physical positions have been measured, orientations of the sensor assemblies 34 and the associated first and second sensors 40 and 42 can be determined (step 104). This orientation determination can include configuration of azimuth angles θ, elevation angles θ, and rotation angle. The azimuth angle θ for each discrete sensor 40 and 42 of a given hybrid sensor assembly 34 can be a dependent degree of freedom, i.e., azimuth angles $\theta_1$ and $\theta_2$ are identical for the first and second sensors 40 and 42, given the mechanical linkage in the preferred embodiment. The second sensor 42 (e.g., machine vision device) can be configured such that a center of the stop-line for the traffic approach 38 substantially aligns with a center of the associated field of view 34-1. Given the mechanical connection between the first and second sensors 40 and 42 in a preferred embodiment, one then knows that alignment of the first sensor 40 (e.g., a bore sight of a radar) has been properly set. The elevation angle β for each sensor 40 and 42 is an independent degree of freedom for the hybrid sensor assembly 34, meaning the elevation angle $\beta_1$ of the first sensor 40 (e.g., radar) can be adjusted independently of the elevation angle $\beta_2$ of the second sensor 42 (e.g., machine vision device).

Once sensor orientation is known, the coordinates of that sensor can be rotated by the azimuth angle θ so that axes align substantially parallel and perpendicular to a traffic direction of the approach 38. Adjustment can be made according to the following equations (1) and (2), where sensor data is provided in x, y Cartesian coordinates:

$$x'=\cos(\theta)*x-\sin(\theta)*y \quad (1)$$

$$y'=\sin(\theta)*x+\cos(\theta)*y \quad (2)$$

Also a second transformation can be used to harmonize axis-labeling conventions of the first and second sensors 40 and 42, according to equations (3) and (4):

$$x''=-y' \quad (3)$$

$$y''=x' \quad (4)$$

A normalization application (e.g., the GUI 102 and/or the configuration wizard 104) can then be opened to begin field of view normalization for the first and second sensors 40 and 42 of each hybrid sensor assembly 34 (step 106). With the normalization application open, objects are positioned on or near the roadway of interest (e.g., roadway intersection 30) in a common field of view of at least two sensors of a given hybrid sensor assembly 34 (step 108). In one embodiment, the objects can be synthetic target generators, which, generally speaking, are objects or devices capable of generating a recordable sensor signal. For example, in one embodiment a synthetic target generator can be a Doppler generator that can generate a radar signature (Doppler effect) while stationary along the roadway 30 (i.e., not moving over the roadway 30). In an alternative embodiment using an infrared (IR) sensor, synthetic target generator can be a heating element. Multiple objects can be positioned simultaneously, or alternatively one or more objects can be sequentially positioned, as desired. The objects can be positioned on the roadway in a path of traffic or on a sidewalk, boulevard, curtilage or other adjacent area. Generally at least three objects are positioned in a non-collinear arrangement. In applications where the hybrid sensor assembly 34 includes three or more discrete sensors, the objects can be positioned in an overlapping field of view of all of the discrete sensors, or of only a subset of the sensors at a given time, though eventually an objects should be positioned within the field of view of each of the sensors of the assembly 34. Objects can be temporarily held in place manually by an operator, or can be self-supporting without operator presence. In still further embodiments, the objects can be existing objects positioned at the roadway 30, such as posts, mailboxes, buildings, etc.

With the object(s) positioned, data is recorded for multiple sensors of the hybrid sensor assembly 34 being normalized, to capture data that includes the positioned objects in the overlapping field of view, that is, multiple sensors sense the object(s) on the roadway within the overlapping fields of view (step 110). This process can involve simultaneous sensing of multiple objects, or sequential recording of one or more objects in different locations (assuming no intervening adjustment or repositioning of the sensors of the hybrid sensor assembly 34 being normalized). After data is captured, an operator can use the GUI 102 to select one or more frames of data recorded from the second sensor 42 (e.g., machine vision device) of the hybrid sensor assembly 34 being normalized that provide at least three non-collinear points that correspond to the locations of the positioned objects in the overlapping field of view of the roadway 30, and selects those points in the one or more selected frames to identify the objects' locations in a coordinate system for the second sensor 42 (step 112). Selecting the points in the frame(s) from the second sensor 42 can be done manually, through a visual assessment by the operator and actuation of an input device (e.g., mouse-click, touch screen contact, etc.) to designate the location of the objects in the frame(s). In an alternate embodiment, a distinctive visual marking can be provided to attached to the object(s) and the GUI 102 can automatically or semi-automatically search through frames to identify and select the location of the markers and therefore also the object(s). The system 32 or 32' can record the selection in the coordinate system associated with second sensor 42, such as pixel location for output of a machine vision device. The system 32 or 32' can also perform an automatic recognition of the objects relative to another coordinate system associated with the first sensor 40, such as in polar coordinates for output of a radar. The operator can select the coordinates of the coordinate system of the first sensor 40 from an object list (due to the possibility that other objects may be sensed on the roadway 30 in addition to the object(s)), or alternatively automated filtering could be performed to select the appropriate coordinates. The selected coordinates of the first sensor 40 can be adjusted (e.g., rotated) in accordance with the orientation determination of step 104 described above. The location selection process can be repeated for all applicable sensors of a given hybrid sensor assembly 34 until locations of the same object(s) have been selected in the respective coordinate systems for each of the sensors.

After points corresponding to the locations of the objects have been selected in each sensor coordinate system, those points are translated or correlated to common coordinates used to normalize and configure the traffic sensing system 32 or 32' (step 114). For instance, radar polar coordinates can be mapped, translated or correlated to pixel coordinates of a machine vision device. In this way, a correlation between data of all of the sensors of a given hybrid sensor assembly 34, so that objections in a common, overlapping field of view of those sensors can be identified in a common coordinate system, or alternatively in a primary coordinate system and mapped into any other correlated coordinate systems for other sensors. In one embodiment, all sensors can be correlated to a common pixel coordinate system.

Next, a verification process can be performed, through operation of the system 32 or 32' and observation of moving objects traveling through the common, overlapping field of view of the sensors of the hybrid sensor assembly 34 being normalized (step 116). This is a check on the normalization already performed, and an operator can adjust or clear and perform again the previous steps to obtain a more desired normalization.

After normalization of the sensor assembly 34, an operator can use the GUI 102 to identify one or more lanes of traffic for one or more approaches 38 on the roadway 30 in the common coordinate system (or in one coordinate system correlated to other coordinate systems) (step 118). Lane identification can be performed manually by an operator drawing lane boundaries on a display of sensor data (e.g., using a machine vision frame or frames depicting the roadway 30). Physical measurements (from step 102) can be used to assist the identification of lanes. In alternative embodiments automated methods can be used to identify and/or adjust lane identifications.

Additionally, an operator can use the GUI 102 and/or the detection editor 106 to establish one or more detection zones (step 120). The operator can draw the detection zones on a display of the roadway 30. Physical measurements (from step 102) can be used to assist the establishment of detection zones.

The method illustrated in FIG. 7 is shown merely by way of example. Those of ordinary skill in the art will appreciate that the method can be performed in conjunction with other steps not specifically shown or discussed above. Moreover, the order of particular steps can vary, or can be performed simultaneously, in further embodiments. Further details of the method shown in FIG. 7 will be better understood in relation to additional figures described below.

Figure 8:
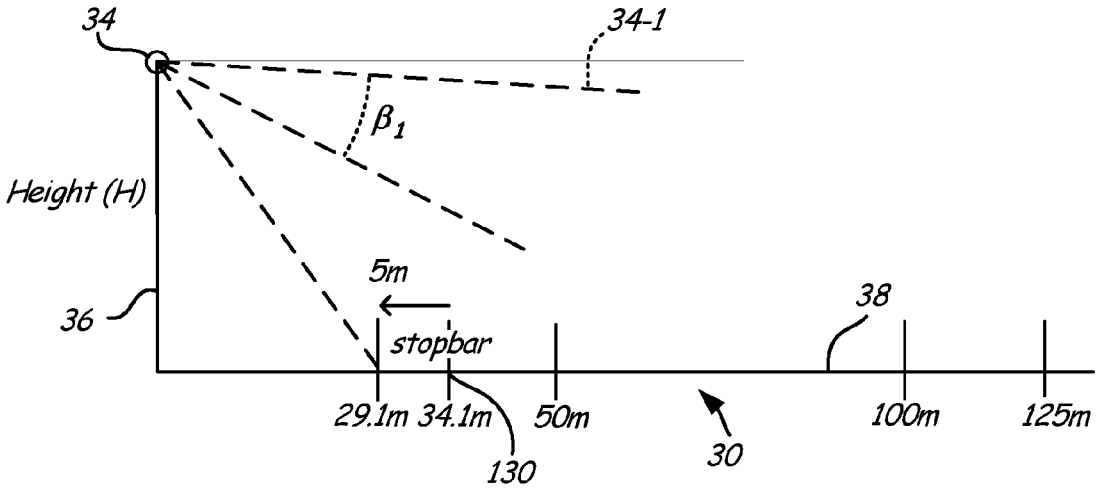
FIG. 8 is an elevation view of a portion of the roadway intersection.

FIG. 8 is an elevation view of a portion of the roadway intersection 30, illustrating an embodiment of the hybrid sensor assembly 34 in which the first sensor 40 is a radar. In the illustrated embodiment, the first sensor 40 is aimed such that its field of view 34-1 extends in front of a stop bar 130. For example, for a stop-bar positioned approximately 30 m from the hybrid sensor assembly 34 (i.e., $D_S$=30 m), the elevation angle $\beta_1$ for the radar (e.g., the first sensor 40) is set such that 10 dB off a main lobe aligns approximately with the stop-bar 130. FIG. 8 illustrates this concept for a luminaire installation (i.e., where the support structure 36 is a luminaire). The radar is configured such that a 10 dB point off the main lobe intersects with the roadway 30 approximately 5 m in front of the stop-line. Half of the elevation width of the radar beam is then subtracted to obtain an elevation orientation value usable by the traffic sensing system 32 or 32'.

Figure 9:
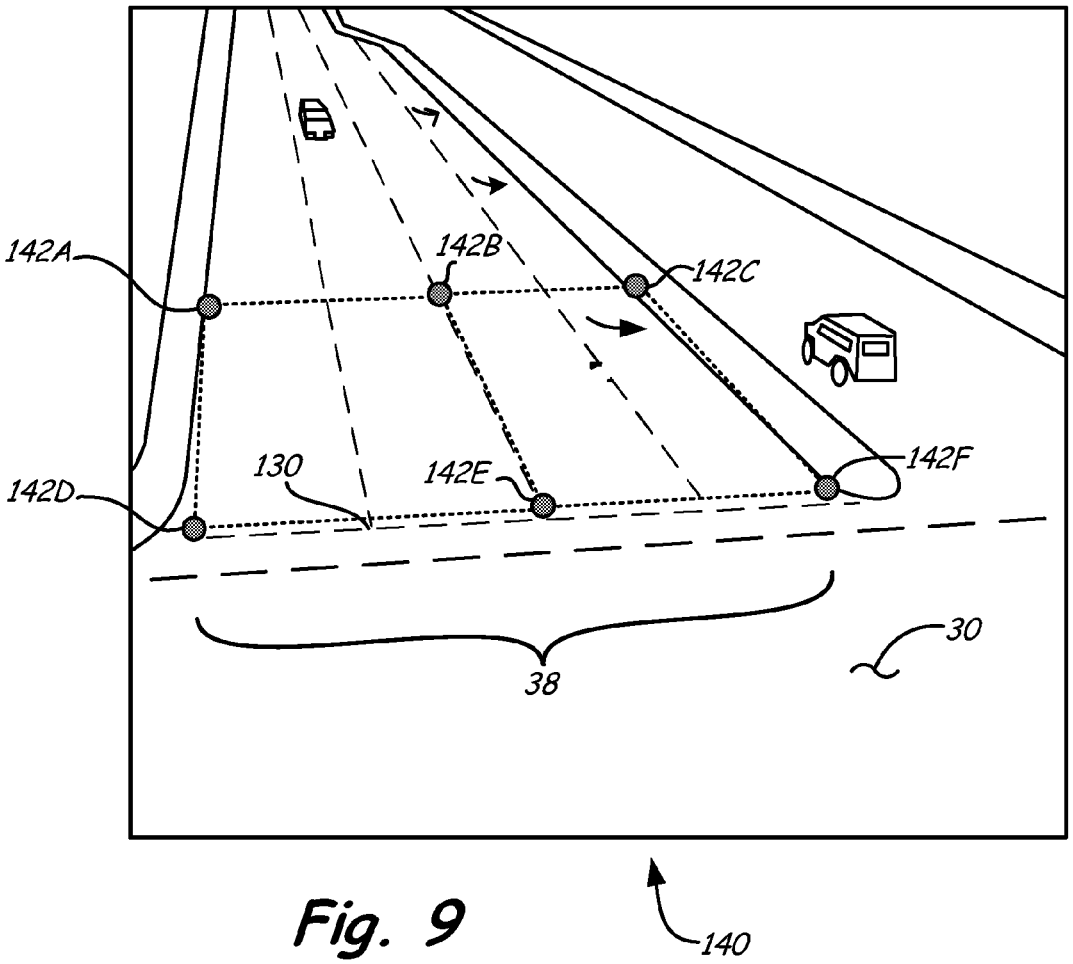
FIG. 9 is an instance of a view of a normalization display interface for establishing coordinate system correlation between multiple sensor inputs, one sensor being a video camera.

FIG. 9 is a view of a normalization display interface 140 of the GUI 102 for establishing coordinate system correlation between multiple sensor inputs from a given hybrid sensor assembly 34. In the illustrated embodiment, six objects 142A-142F are positioned in the roadway 30. In some embodiments it may be desirable to position the objects 142A-142F in meaningful locations on the roadway 30, such as along lane boundaries, along the stop bar 130, etc. Meaningful locations will generally corresponding to the type of detection(s) desired for a given application. Alternatively, the objects 142A-142F can be positioned outside of the approach 38, such as on a median or boulevard strip, sidewalk, etc., to reduce obstruction of traffic on the approach 38 during normalization.

The objects 142A-142F can each be synthetic target generators (e.g., Doppler generators, etc.). In general, synthetic target generators are objects or devices capable of generating a recordable sensor signal, such as a radar signature (Doppler effect) generated while the object is stationary along the roadway 30 (i.e., not moving over the roadway 30). In this way, a stationary object on the roadway 30 can given the appearance of being a moving object that can be sensed and detected by a radar. For instance, mechanical and electrical Doppler generators are known, and any suitable Doppler generator can be used with the present invention as a synthetic target generator for embodiments utilizing a radar sensor. A mechanical or electro-mechanical Doppler generator can include a spinning fan in a slit enclosure having a slit. An electrical Doppler generator can include a transmitter to transmit an electromagnetic wave to emulate a radar return signal (i.e., emulating a reflected radar wave) from a moving object at a suitable or desired speed. Although a typical radar cannot normally detect stationary objects, a synthetic target generator like a Doppler generator makes such detection possible. For normalization as described above with respect to FIG. 7, stationary objects are much more convenient than moving objects. Alternatively, the objects 142A-142F can be objects that move or are moved relative to the roadway 30, such as corner reflectors that halp provide radar reflection signatures.

Although six objects 142A-142F are shown in FIG. 9, only a minimum of three non-collinearly positioned objects need to be positioned in other embodiments. Moreover, as noted above, not all of the objects 142A-142F need to be positioned simultaneously.

Figure 10:
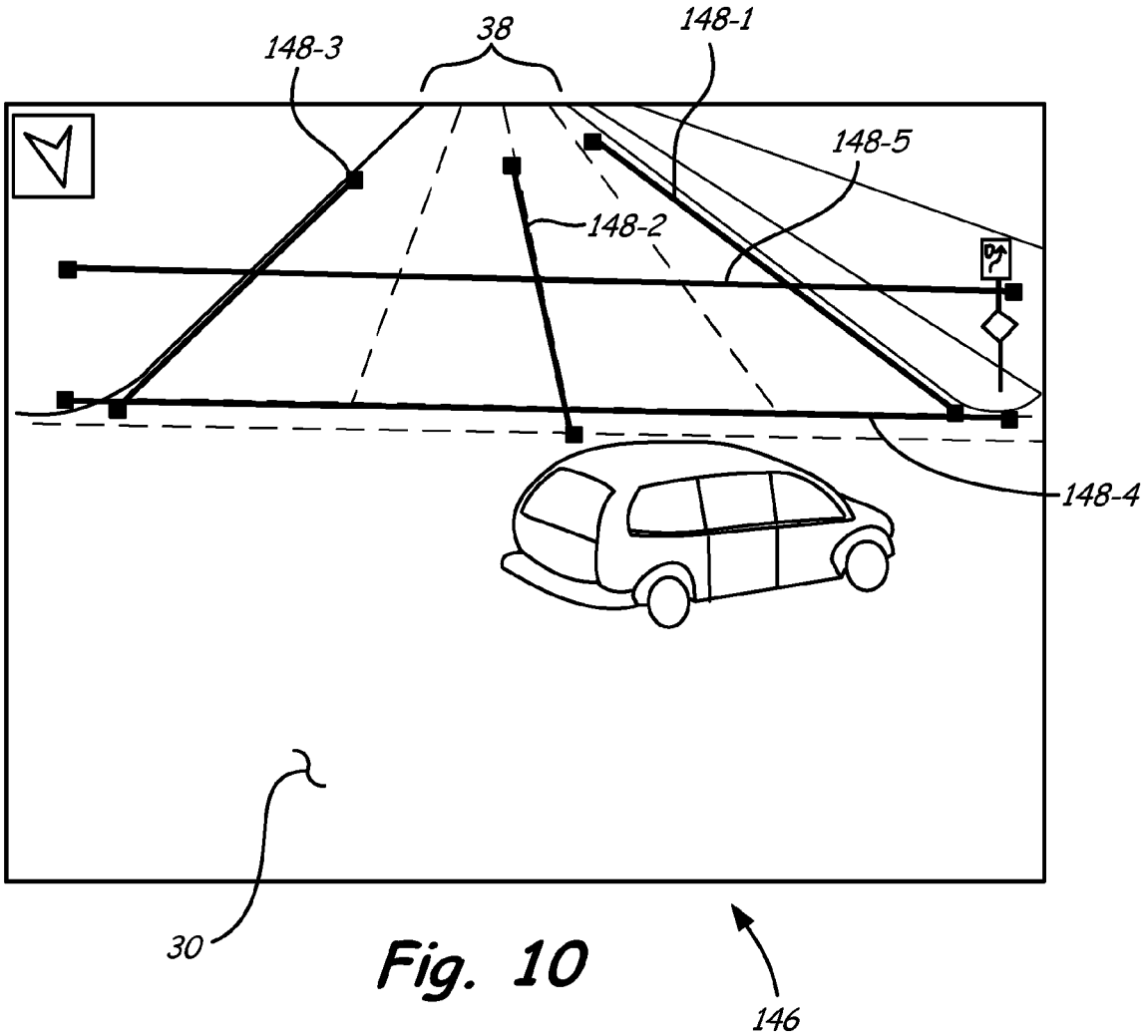
FIG. 10 is a view of a normalization display for establishing traffic lanes using an instance of machine vision data.

FIG. 10 is a view of a normalization display 146 for establishing traffic lanes using machine vision data (e.g., from the second sensor 42). Lane boundary lines 148-1, 148-2 and 148-3 can be manually drawn over a display of sensor data, using the GUI 102. A stop line boundary 148-4 and a boundary of a region of interest 148-5 can also be drawn over a display of sensor data by an operator. Moreover, although the illustrated embodiment depicts an embodiment with linear boundaries, non-linear boundaries can be provided for different roadway geometries. Drawing boundary lines as shown in FIG. 10 can be performed after a correlation between sensor coordinate systems has been established, allowing the boundary lines drawn with respect to one coordinate system to be mapped or correlated to another or universal coordinate system (e.g., in an automatic fashion).

As an alternative to having an operator manually draw the stop line boundary 148-4, an automatic or semi-automatic process can be used in further embodiments. The stop line position is usually difficult to find, because there is only one somewhat noisy indicator: where objects (e.g., vehicles) stop. Objects are not guaranteed to stop exactly on the stop line (as designated on the roadway 30 by paint, etc.); they could stop up to several meters ahead or behind the designated stop line on the roadway 30. Also, some sensing modalities, such as radar, can have significant errors in estimating positions of stopped vehicles. Thus, an error of +/− several meters can be expected in a stop line estimate. The stop line position can be found automatically or semi-automatically by averaging a position (e.g., a y-axis position) of a nearest stopped object in each measurement/sensing cycle. Taking only the nearest stopped objects helps eliminate undesired skew caused by non-front objects in queues (i.e., second, third, etc. vehicles in a queue). This dataset will have some outliers, which can be removed using an iterative process (similar to one that can be used in azimuth angle estimates):

(a) Take a middle 50% of samples nearest a stop line position estimate (inliers), and discard the other 50% of points (outliers). An initial stop line position estimate can be an operator's best guess, informed by any available physical measurements, geographic information system (GIS) data, etc.

(b) Determine a mean (average) of the inliers, and consider this mean the new stop line position estimate.

(c) Repeat steps (a) and (b) until method converges (e.g., 0.0001 delta between steps (a) and (b)) a threshold number of iterations of steps (a) and (b) have been reached (e.g., 100 iterations). Typically, method should converge within around 10 iterations. After convergence or reaching the iteration threshold, a final estimate of this the stop line boundary position is obtained. A small offset can be applied, as desired.

Figure 11A:
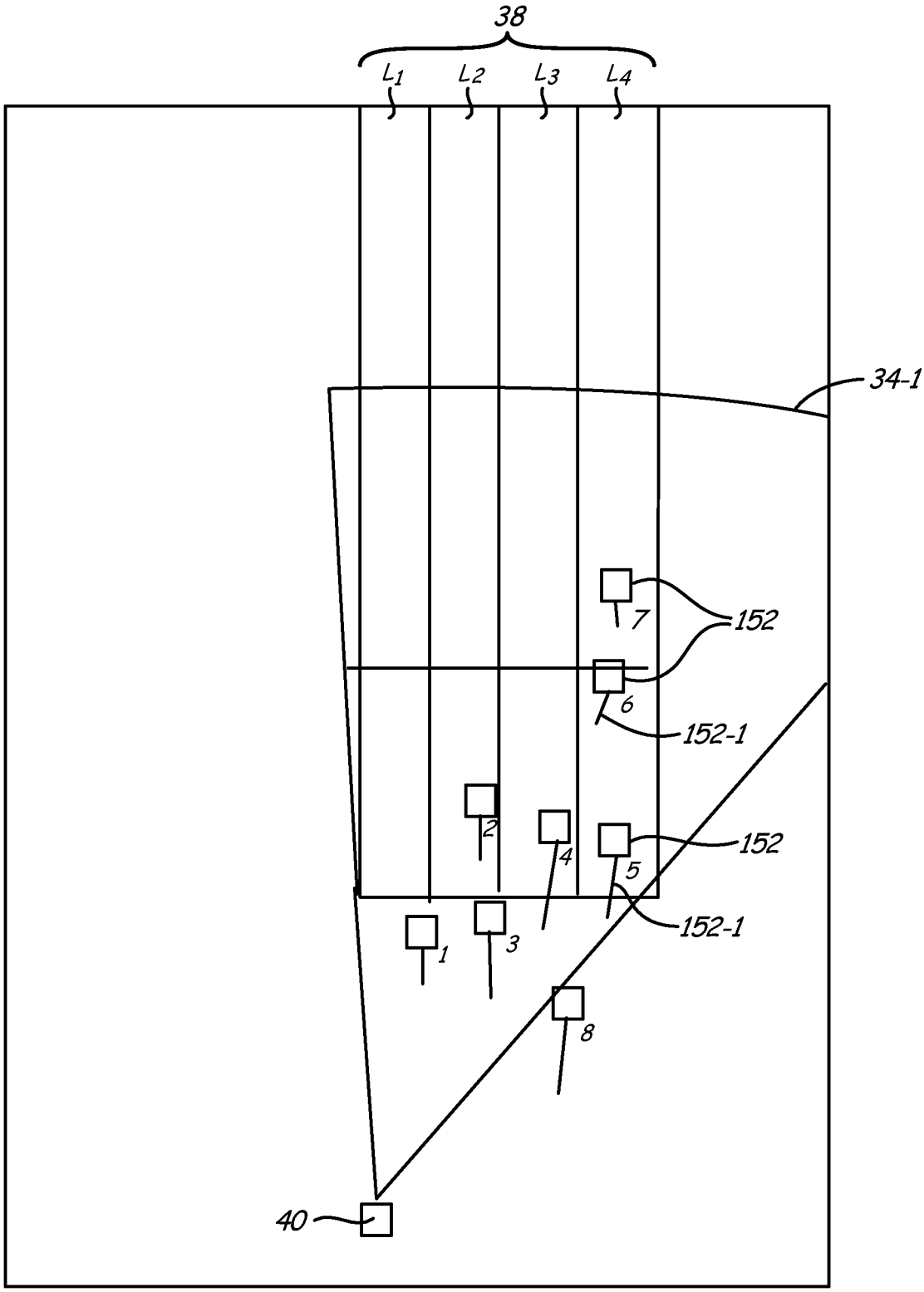
FIG. 11A is a view of one normalization display for one form of sensor orientation detection and normalization.
Figure 11B:
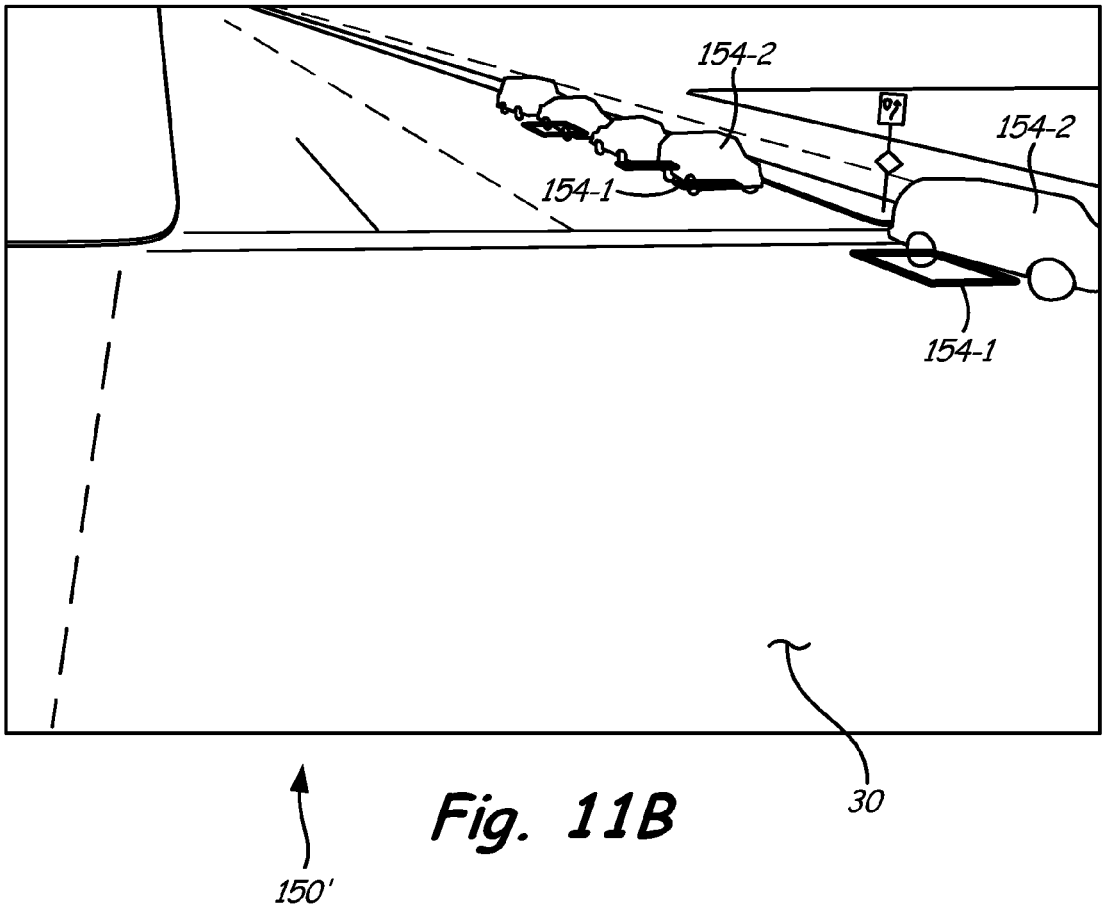
FIG. 11B is a view of another normalization display for another form of sensor orientation detection and normalization.
Figure 11C:
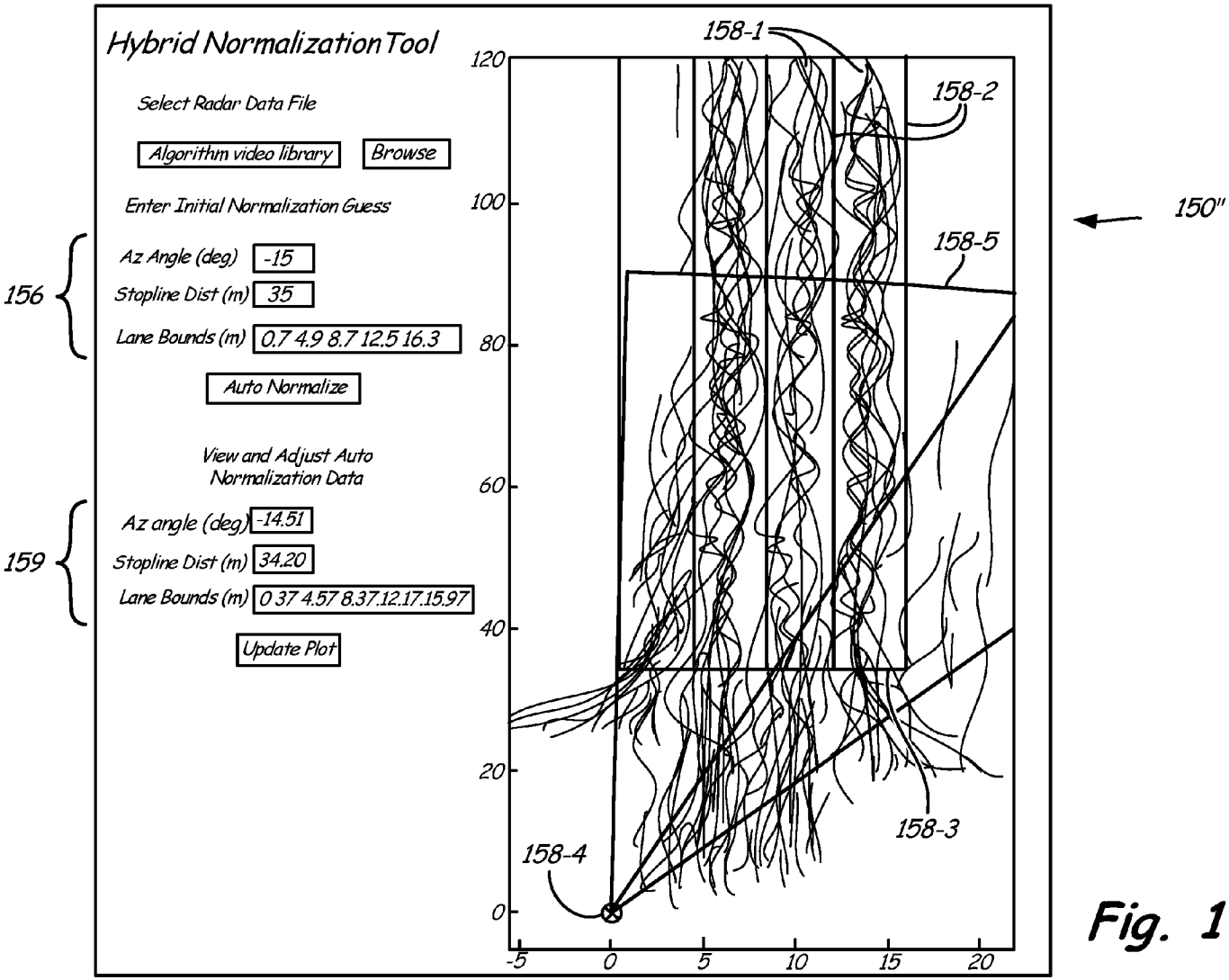
FIG. 11C is a view of yet another normalization display for another form of sensor orientation detection and normalization.

It is generally necessary to provide orientation information to the system 32 or 32' to allow suitable recognition of the orientation of the sensors of the hybrid sensor assembly 34 relative to the roadway 30 desired to be sensed. Two possible methods for determining orientation angles are illustrated in FIGS. 11A, 11B and 11C. FIG. 11A is a view of a normalization display 150 for one form of sensor orientation detection and normalization. As shown in the illustrated embodiment of FIG. 11A, a radar output (e.g., of the first sensor 40) is provided in a first field of view 34-1 for four lanes of traffic $L_1$ to $L_4$ of the roadway 30. Numerous objects 152 (e.g., vehicles) are detected in the field of view 34-1, and a movement vector 152-1 is provided for each detected object. It should be noted that it is well-known for radar sensor systems to provide vector outputs for detected moving objects. By viewing the display 150 (e.g., with the GUI 102), an operator can adjust an orientation of the first sensor 40 recognized by the system 32 or 32' such that vectors 152-1 substantially align with the lanes of traffic $L_1$ to $L_4$. Lines designating lanes of traffic $L_1$ to $L_4$ can be manually drawn by an operator (see FIG. 10). This approach assumes that sensed objects travel substantially parallel to lanes of the roadway 30. Operator skill can account for any outliers or artifacts in data used for this process.

FIG. 11B is a view of another normalization display 150' for another form of sensor orientation detection and normalization. In the embodiment illustrated in FIG. 11B, the display 150' is a video overlay of image data from the second sensor 42 (e.g., machine vision device) with bounding boxes 154-1 of objects detected with the first sensor 40 (e.g., radar). An operator can view the display 150' to assess and adjust alignment between the bounding boxes 154-1 and depictions of objects 154-2 visible on the display 150'. Operator skill can be used to address any outliers or artifacts in data used for this process.

FIG. 11C is a view of yet another normalization display 150" for another form of sensor orientation detection and normalization. In the embodiment illustrated in FIG. 11C, an automated or semi-automated procedure allows sensor orientation determination and normalization. The procedure can proceed as follows. First, sensor data of vehicle traffic is recorded for a given period of time (e.g., 10-20 minutes), and saved. An operator then opens the display 150" (e.g., part of the GUI 102), and accesses the saved sensor data. The operator enters an initial normalization guess in block 156 for a given sensor (e.g., the first sensor 40, which can be a radar), which can include a guess as to azimuth angle θ, stop line position and lane boundaries. These guesses can be informed by physical measurements, or alternatively using engineering/technical drawings or distance measurement tools of electronic GIS tools, such as GOOGLE MAPS, available from Google, Inc., Mountain View, Calif., or BING MAPS, available from Microsoft Corp. The azimuth angle θ guess can match the applicable sensor's setting at the time of the recording. The operator can then request that the system take the recorded data and the initial guesses and compute the most likely normalization. Results can be shown and visually displayed, with object tracks 158-1, lane boundaries 158-2, stop line 158-3, the sensor position 158-4 (located at origin of distance graph) and field of view 158-5. The operator can visually assess the automatic normalization, and can make any desired changes in the results block 159, which refreshing of the plot after adjustment. This feature allows manual fine-tuning of the automated results.

Steps of the auto-normalization algorithm can be as described in the following embodiment. The azimuth angle θ is estimated first. Once the azimuth angle θ is known, the object coordinates for the associated sensor (e.g., the first sensor 40) can be rotated so that axes of the associated coordinate system align parallel and perpendicular to the traffic direction. This azimuth angle θ simplifies estimation of the stop line and lane boundaries. Next, the sensor coordinates can be rotated as a function of the azimuth angle θ the user entered as an initial guess. The azimuth angle θ is computed by finding an average direction of travel of the objects (e.g., vehicles) in the sensor's field of view. It is assumed that on average objects will travel parallel to lane lines. Of course, vehicles executing turning maneuvers or changing lanes will violate this assumption. Those types of vehicles produce outliers in the sample set that must be removed. Several different methods are employed to filter outliers. As an initial filter, all objects with speed less than a given threshold (e.g., approximately 24 km/hr or 15 ml/hr) can be removed. Those objects are considered more likely to be turning vehicles or otherwise not traveling parallel to lane lines. Also, any objects with a distance outside of approximately 5 to 35 meters past the stop line are removed; objects in this middle zone are considered the most reliable candidates to be accurately tracked while travelling within the lanes of the roadway 30. Because the stop line location is not yet known, the operator's guess can be used at this point. Now using this filtered dataset, an angle of travel for each tracked object is computed by taking the arctangent of the associated x and y velocity components. An average angle of all the filtered, tracked objects produces an azimuth angle θ estimate. However, at this point, outliers could still be skewing the result. A second outlier removal step can now be employed as follows:

(a) Take a middle 50% of samples nearest the azimuth angle θ estimate (inliers), and discard the other 50% of points (outliers);

(b) Take the mean of the inliers, and consider this the new azimuth angle θ estimate; and (c) Repeat steps (a) and (b) until the method converges (e.g., 0.0001 delta between steps (a) and (b)) or a threshold number of iterations of steps (a) and (b) have been reached (e.g., 100 iterations). Typically, this method should converge within around 10 iterations. After converging or reaching the iteration threshold, the final azimuth angle θ estimate is obtained. This convergence can be graphically represented as a histogram, if desired.

Figures 12A, 12B, 12C, 12D, 12E:
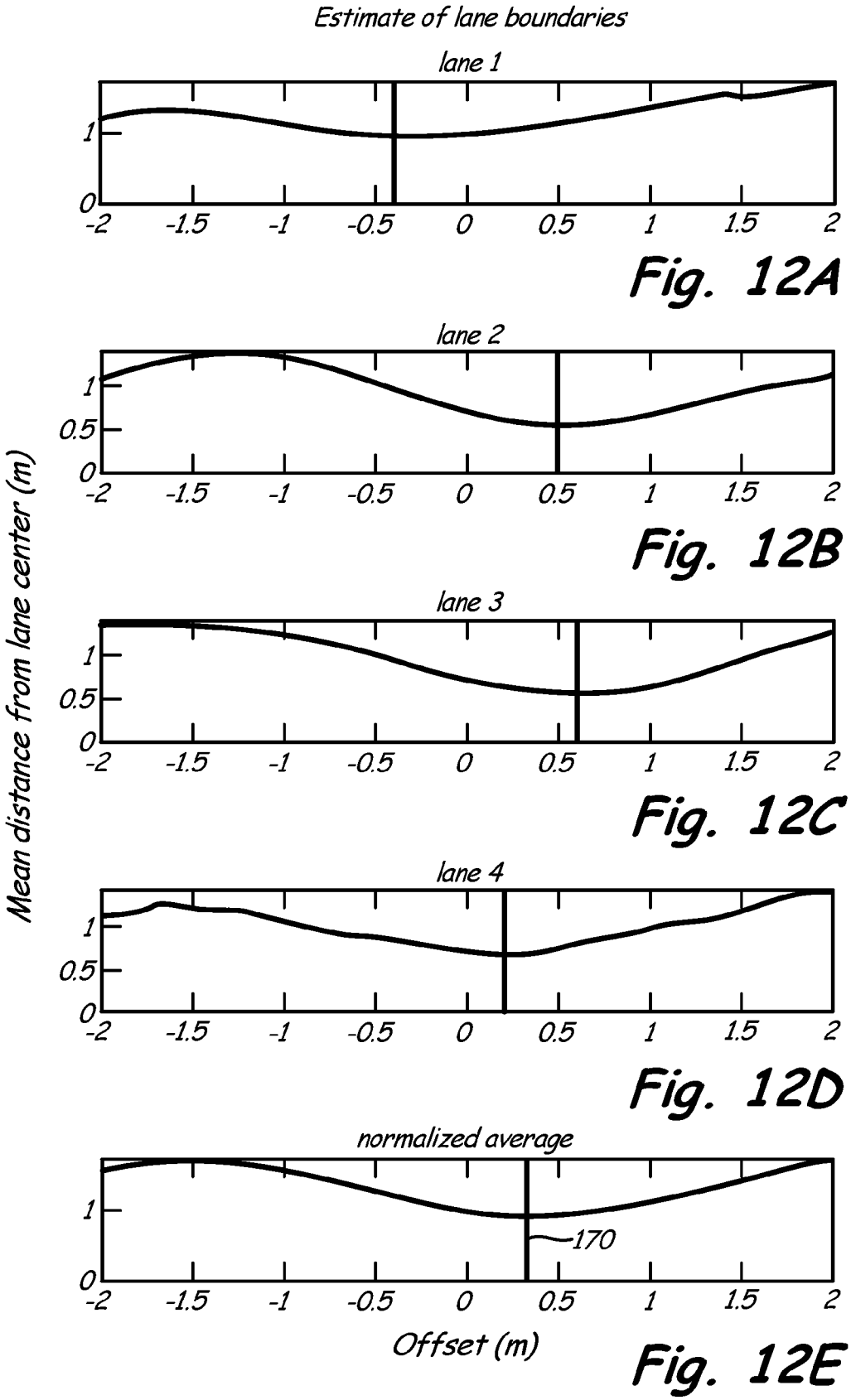
FIGS. 12A-12E are lane boundary estimate graphs.

FIGS. 12A-12E are graphs of lane boundary estimates for an alternative embodiment of a method of automatic or semi-automatic lane boundary establishment or adjustment. In general, this embodiment assumes objects (e.g., vehicles) will travel in approximately a center of the lanes of the roadway 30, and involves an effort to reduce or minimize an average distance to the nearest lane center for each object. A user's initial guess is used as a starting point for the lane centers (including the number of lanes), and then small shifts are tested to see if they give a better result. It is possible to leave lane widths constant at the user's guesses (which can be based on physical measurements), and only horizontal shifts of lane locations applied. A search window of +/−2 meters can be used, with 0.1 meter lane shift increments. For each search position, lane boundaries are shifted by the offset, then an average distance to center of lane is computed for all vehicles in each lane (this can be called an "average error" of the lane). After trying all possible offsets, the average errors for each lane can be normalized by dividing by a minimum average error for that lane over all possible offsets. This normalization provides a weighting mechanism that increases a weight assigned to lanes where a good fit to vehicle paths is found and reduces the weight of lanes with more noisy data. Then the normalized average errors of all lanes can be added together for each offset, as shown in FIG. 12E. The offset giving a lowest total normalized average error (designated by line 170 in FIG. 12E) can be taken as the best estimate. The user's initial guess, adjusted by the best estimate offset, can be used to establish the lane boundaries for the system 32 or 32'. As noted already, in this embodiment, a single offset for all lanes is used to shift all lanes together, rather than to adjust individual lane sizes to provide for different shifts between different lanes.

Figure 13:
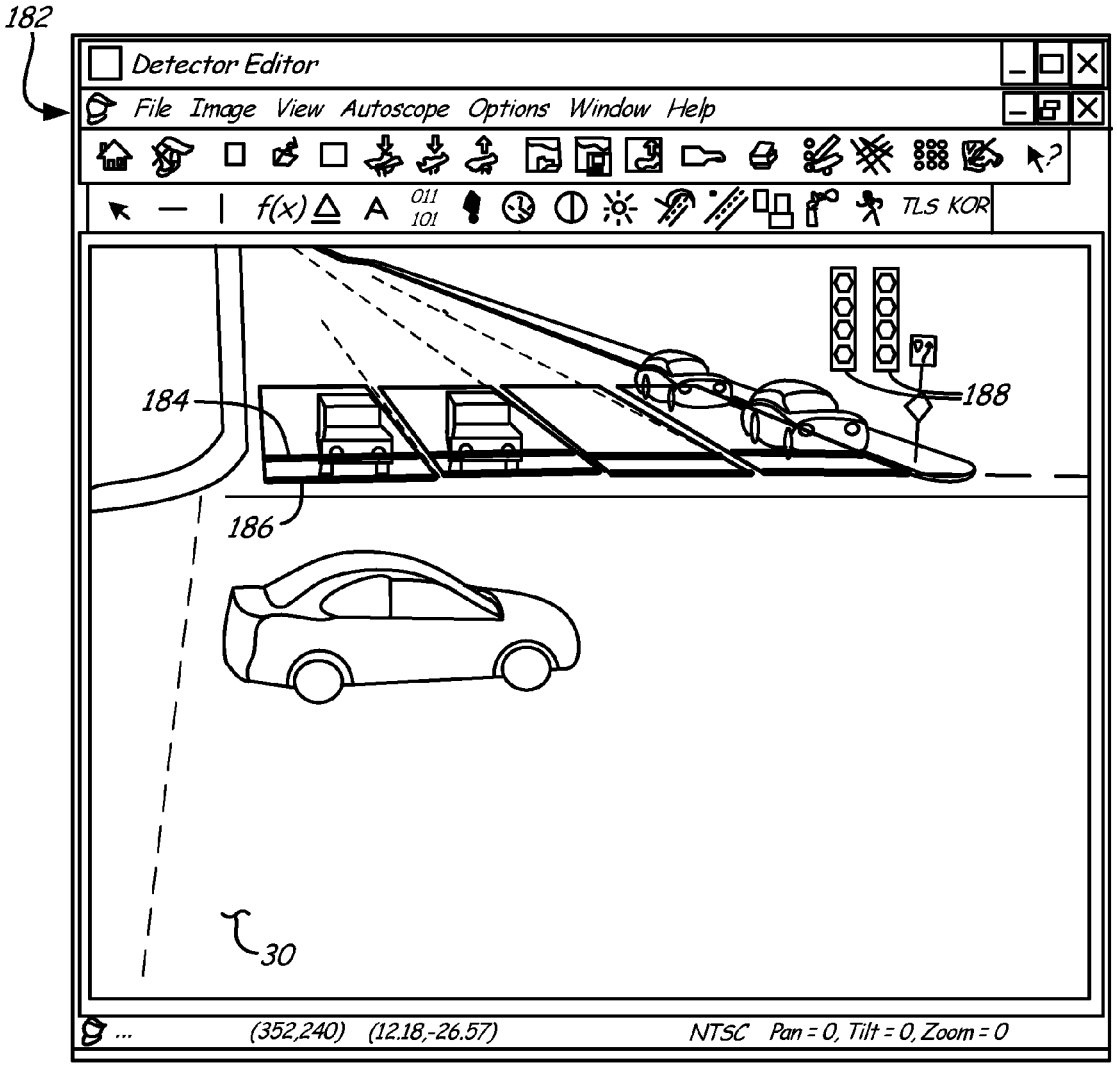
FIG. 13 is a view of a calibration display interface for establishing detection zones.

FIG. 13 is a view of a calibration display interface 180 for establishing detection zones, which can be implemented via the detector editor 106. Generally speaking, detection zones are areas of a roadway in which the presence of an object (e.g., vehicle) is desired to be detected by the system 32 or 32'. Many different types of detectors are possible, and the particular number or types employed for a given application can vary as desired. The display 180 can include a menu or toolbar 182 for providing a user with tools for designating detectors with respect to the roadway 30. In the illustrated embodiment, the roadway 30 is illustrated adjacent to the toolbar 182 based upon machine vision sensor data. Detector zones, such as stop line detectors 184 and speed detectors 186 are defined relative to desired locations. Furthermore, other information icons 188 can be selected for display, such as signal state indicators. The display interface 180 allows detectors and related system parameters to be set that are used during normal operation of the system 32 or 32' for traffic sensing. Configuration of detector zones can be conducted independent from the normalization process described above. The configuration of detection zones can occur in pixel/image space and is generally not reliant on the presence of vehicle traffic. Configuration of detection zones can occur after the coordinate systems for multiple sensors are normalized.

Figure 14:
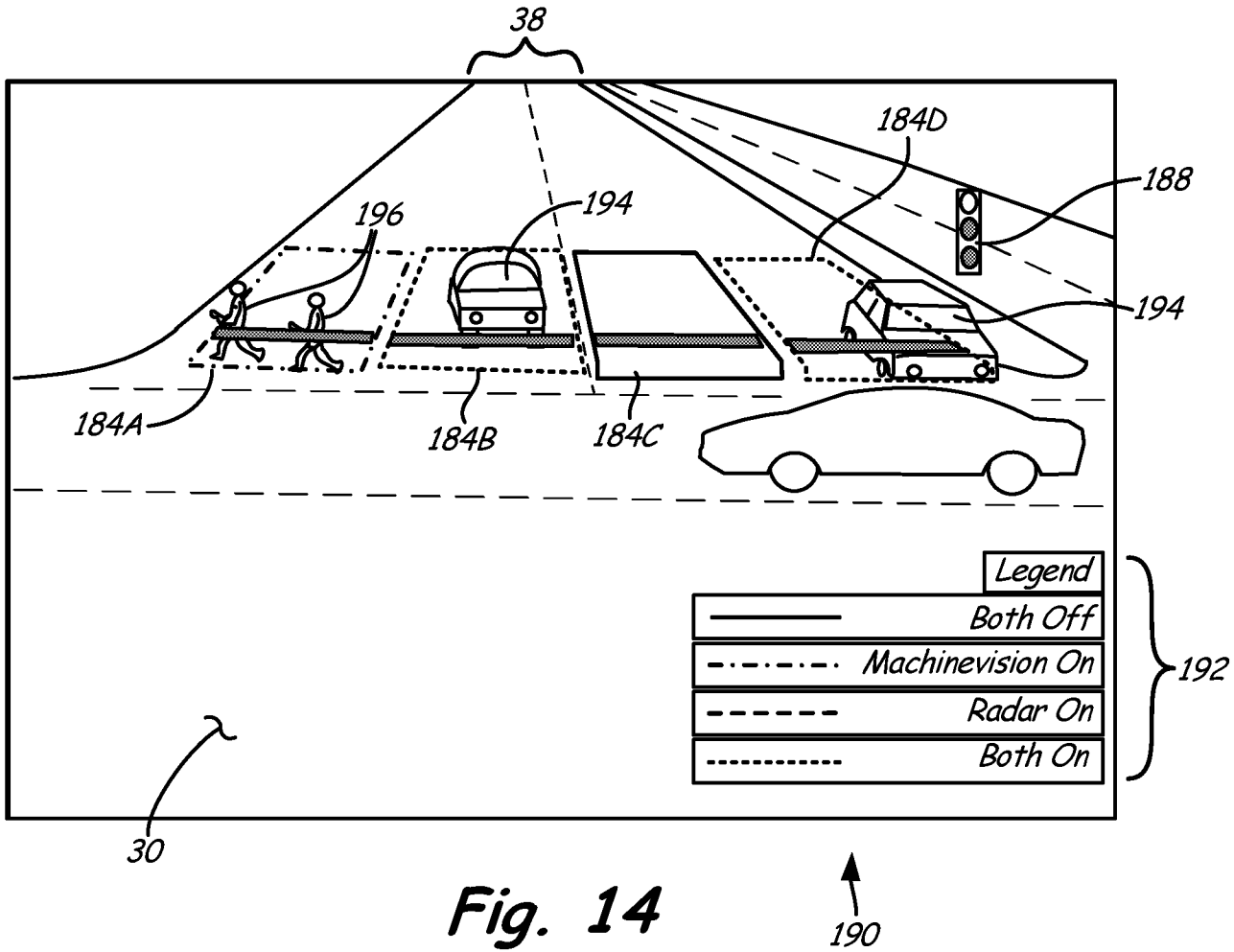
FIG. 14 is a view of an operational display, showing an example comparison of detections from two different sensor modalities.

FIG. 14 is a view of an operational display 190 of the traffic sensing system 32 or 32', showing an example comparison of detections from two different sensor modalities (e.g., the first and second sensors 40 and 42) in a video overlay (i.e., graphics are overlaid on a machine vision sensor video output). In the illustrated embodiment, detectors 184A to 184D are provided, one in each of four lanes of the illustrated roadway 30. A legend 192 is provided in the illustrated embodiment to indicate whether no detections are made ("both off"), only a first sensor makes a detection ("radar on"), only a second sensor makes a detection ("machine vision on"), or whether both sensors make a detection. As shown, vehicles 194 have triggered detections for detectors 184B and 184D for both sensors, while the machine vision sensor has triggered a "false" detection for detector 184A based on the presence of pedestrians 196 traveling in a cross-lane direction perpendicular to the direction of the approach 38 who did not trigger one sensor (radar). The illustration of FIG. 14 shows how different sensing modalities can operate different under given conditions.

As already noted, the present invention allows for switching between different sensors or sensing modalities based upon operating conditions at the roadway and/or type of detection. In one embodiment, the traffic sensing system 32 or 32' can be configured as a gross switching system in which multiple sensors run simultaneously (i.e., operate simultaneously to sense data) but with only one sensor being selected at any given time for detection state analysis. The HDSMs 90-1 to **90-*n*** carry out logical operations based on the type of sensor being used, taking into account the type of detection.

One embodiment of a sensor switching approach is summarized in Table 1, which applies to post-processed data from the sensors 40-1 to **40-*n* and 42-1 to 40-*n* from the hybrid sensor assemblies 34**. A final output of any sensor subsystem can simply be passed through on a go/no-go basis to provide a final detection decision. This is in contrast to a data fusion approach that makes detection decisions based upon fused data from all of the sensors. The inventors have developed rules in Table 1 based on comparative field-testing between machine vision and radar sensing, and discoveries as to beneficial uses and switching logic. All the rules of Table 1 assume use of a radar deployed for detection up to 50 m after (i.e., upstream from) a stop line and then machine vision is relied upon past that 50 m region. Other rules can be applied under different configuration assumptions. For example, with a narrower radar antenna field of view, the radar could be relied upon at relatively longer ranges than machine vision.

TABLE 1

| DETECTOR TYPE | RULES |
|---|---|
| COUNT | For mast-arm installations, use Machine Vision<br>For luminaire installations, use Radar by default<br>If low contrast, use Radar<br>Use a combination of Machine Vision & Radar to identify and remove outliers |
| SPEED | For dense traffic or congestion, use Machine Vision<br>For low contrast (night-time, snow, fog, etc.), use Radar |
| STOP LINE DETECTOR | By default, use Machine Vision,<br>EXCEPT:<br>When strong shadows are detected, use Radar<br>For low contrast (nighttime, snow, fog, etc.), use Radar |
| PRESENCE | By default, use the Machine Vision,<br>For Directional, use a combination of Machine Vision & Radar to identify and remove occlusion and/or cross traffic<br>EXCEPT:<br>When strong shadows are detected, use Radar<br>For low contrast (night-time, snow, fog, etc.), use Radar |
| QUEUE | Use Radar for queues up to 100 m, informed by Machine Vision<br>EXCEPT:<br>For dense traffic or congestion, use Machine Vision<br>When strong shadows are detected, use Radar<br>For low contrast (night-time, snow, fog, etc.), use Radar |
| TURN MOVEMENT | Use the Radar<br>Optionally use Machine Vision for inside intersection delayed turns |
| VEHICLE CLASSIFICATION | Use Machine Vision<br>EXCEPT:<br>For nighttime, low contrast and poor weather conditions, use Radar |
| DIRECTIONAL WARNING | Use Radar |

Figure 15:
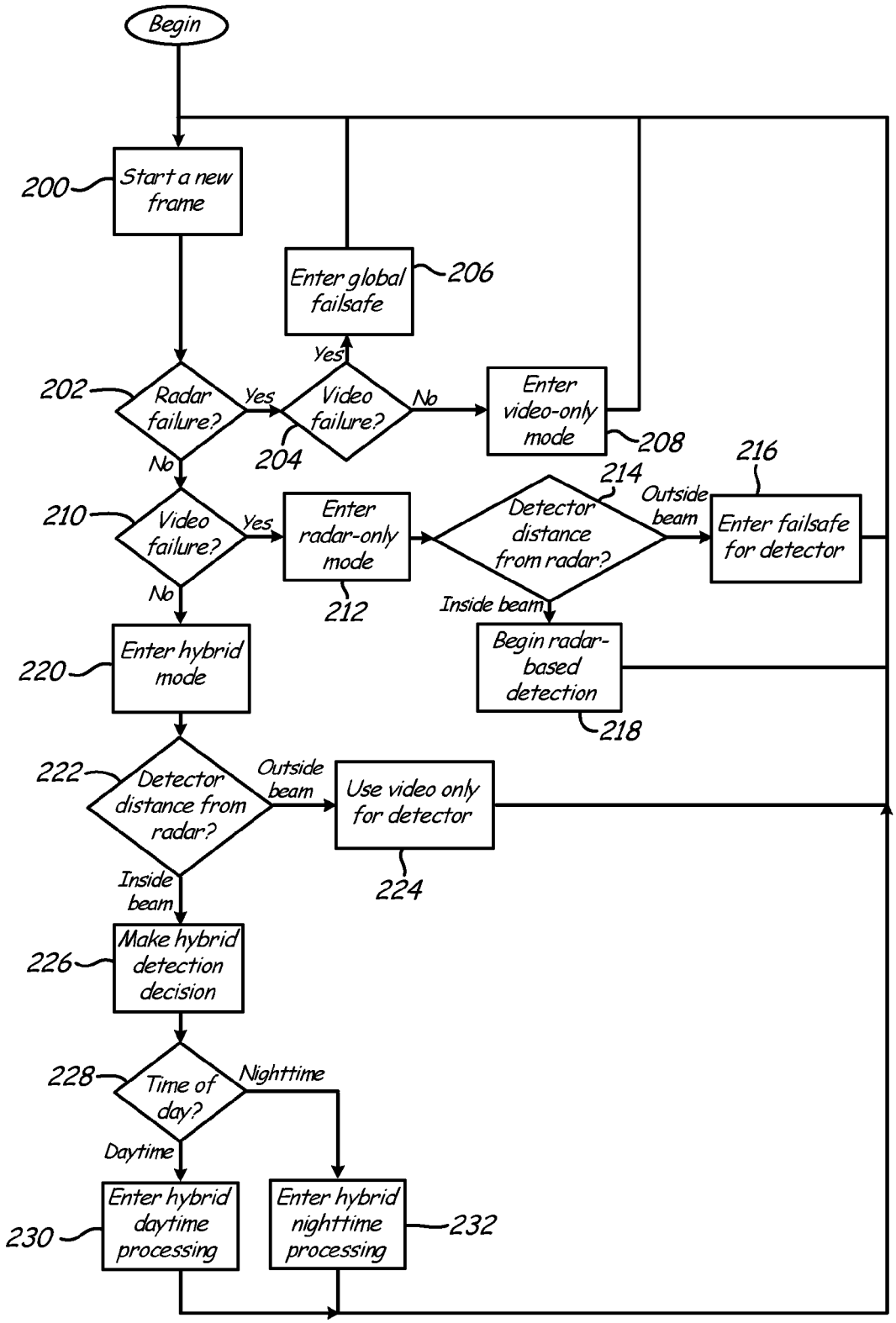
FIG. 15 is a flow chart illustrating an embodiment of a method of sensor modality selection.

FIG. 15 is a flow chart illustrating an embodiment of a method of sensor modality selection, that is, sensor switching, for use with the traffic sensing system 32 or 32'. Initially, a new frame is started, representing newly acquired sensor data from all available sensing modalities for a given hybrid sensor assembly 34 (step 200). A check for radar (or other first sensor) failure is performed (step 202). If a failure is recognized at step 202, another check for video (or other second sensor) failure is performed (step 204). If all sensors have failed, the system 32 or 32' can be placed in a global failsafe mode (step 206). If the video (or other second sensor) is still operational, the system 32 or 32' can enter a video-only mode (step 208). If there is no failure at step 202, another check for video (or other second sensor) failure is performed (step 210). If the video (or other second sensor) has failed, the system 32 or 32' can enter a radar-only mode (step 212). In radar-only mode, a check of detector distance from the radar sensor (i.e., the hybrid sensor assembly 34) is performed (step 214). If the detector is outside the radar beam, a failsafe mode for radar can be entered (step 216), or if the detector is inside the radar beam then radar-based detection can begin (step 218).

If all of the sensors are working (i.e., none have failed), the system 32 or 32' can enter a hybrid detection mode that can take advantage of sensor data from all sensors (step 220). A check of detector distance from the radar sensor (i.e., the hybrid sensor assembly 34) is performed (step 222). Here, detector distance can refer to a location and distance of a given detector defined within a sensor field of view in relation to a given sensor. If the detector is outside the radar beam, the system 32 or 32' can use only video sensor data for the detector (step 224), or if the detector is inside the radar beam then a hybrid detection decision can be made (step 226). Time of day is determined (step 228). During daytime, a hybrid daytime processing mode (see FIG. 16) is entered (step 230), and during nighttime, a hybrid nighttime processing mode (see FIG. 17) is entered (step 232).

The process described above with respect to FIG. 15 can be performed for each frame analyzed. The system 32 or 32' can return to step 200 for each new frame of sensor data analyzed. It should be noted that although the disclosed embodiment refers to machine vision (video) and radar sensors, the same method can be applied to systems using other types of sensing modalities. Moreover, those of ordinary skill in the art will appreciate the disclosed method can be extended to systems with more than two sensors. It should further be noted that sensor modality switching can be performed across an entire common, overlapping field of view of the associated sensors, or can be localized for switching of sensor modalities for one or more portions of the common, overlapping field of view. In the latter embodiment, different switching decisions can be made for different portions of the common, overlapping field of view, such as to make different switching decisions for different detector types, different lanes, etc.

Figure 16:
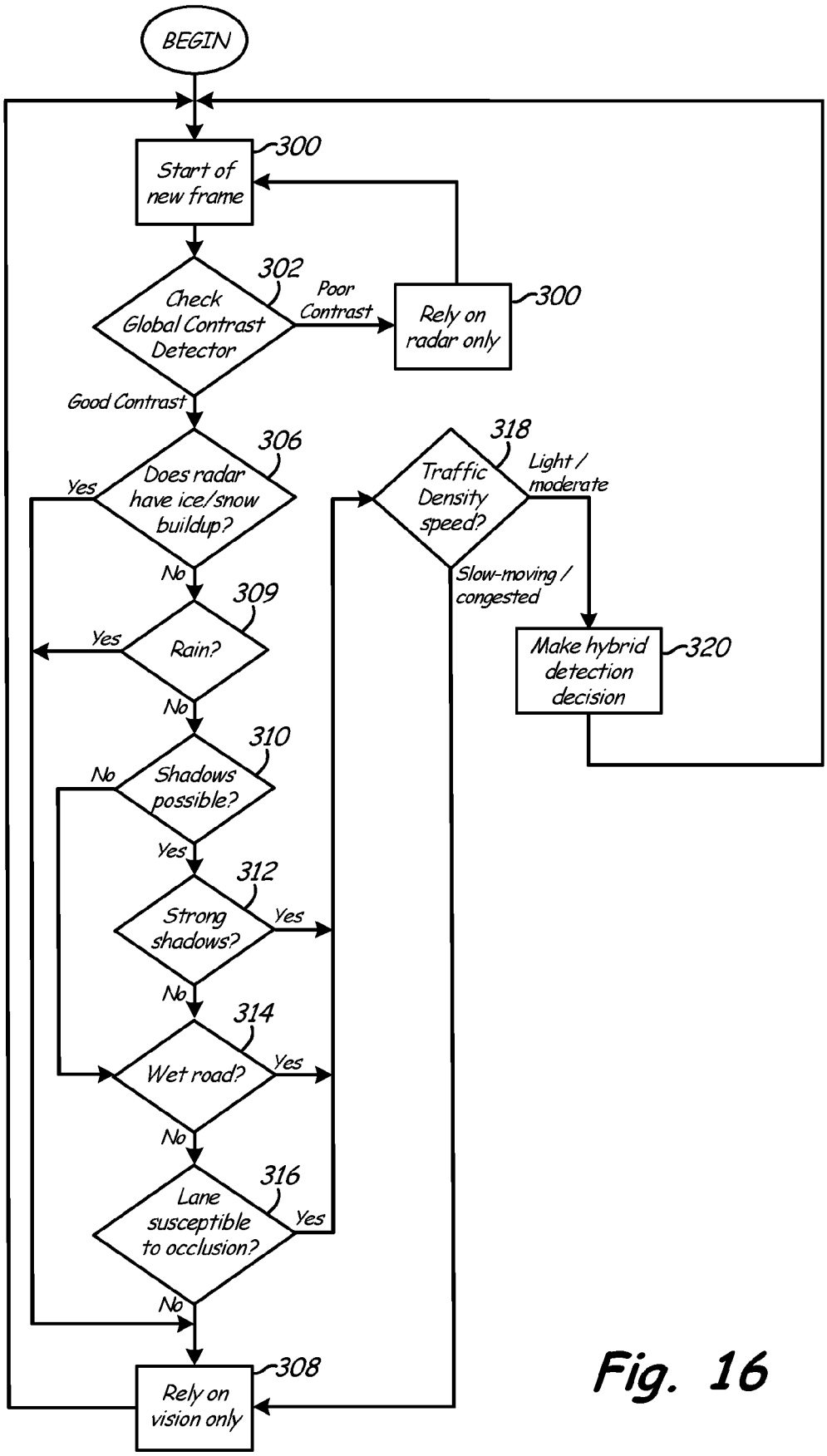
FIG. 16 is a flow chart illustrating an embodiment of a method of sensor selection based on expected daytime conditions.

FIG. 16 is a flow chart illustrating an embodiment of a method of daytime image processing for use with the traffic sensing system 32 or 32'. The method illustrated in FIG. 16 can be used at step 230 of FIG. 15.

For each new frame (step 300), a global contrast detector, which can be a feature of a machine vision system, can be checked (step 302). If contrast is poor (i.e., low), then the system 32 or 32' can rely on radar data only for detection (step 304). If contrast is good, that is, sufficient for machine vision system performance, then a check is performed for ice and/or snow buildup on the radar (i.e., radome) (step 306). If there is ice or snow buildup, the system 32 or 32' can rely on machine vision data only for detection (step 308).

If there is no ice or snow buildup on the radar, then a check can be performed to determine if rain is present (step 309). This rain check can utilize input from any available sensor. If no rain is detected, then a check can be performed to determine if shadows are possible or likely (step 310). This check can involve a sun angle calculation or use any other suitable method, such as any described below). If shadows are possible, a check is performed to verify if strong shadows are observed (step 312). If shadows are not possible or likely, or if no strong shadows are observed, then a check is performed for wet road conditions (step 314). If there is no wet road condition, a check can be performed for a lane being susceptible to occlusion (step 316). If there is no susceptibility to occlusion, the system 32 or 32' can reply on machine vision data only for detection (step 308). In this way, machine vision can act as a default sensing modality for daytime detection. If rain, strong shadows, wet road, or lane occlusion conditions exist, then a check can be performed for traffic density and speed (step 318). For slow moving and congested conditions, the system 32 or 32' can rely on machine vision data only (go to step 308). For light or moderate traffic density and normal traffic speeds, a hybrid detection decision can be made (step 320).

Figure 17:
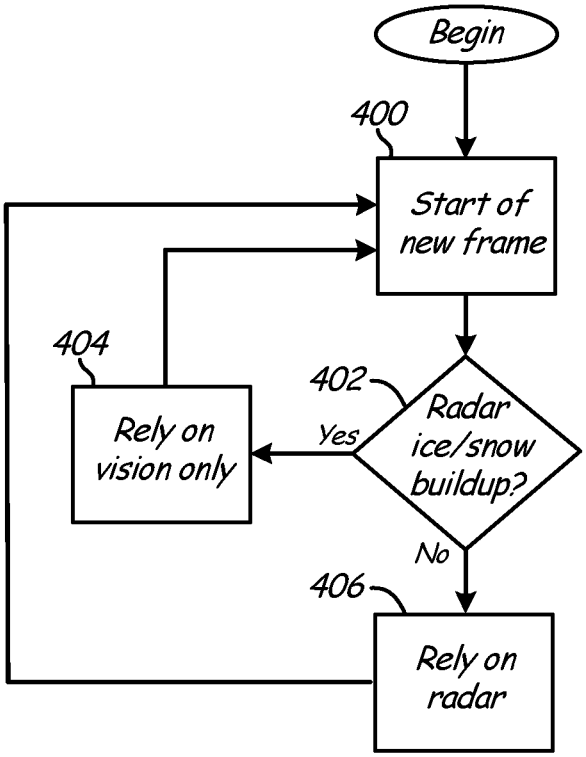
FIG. 17 is a flow chart illustrating an embodiment of a method of sensor selection based on expected nighttime conditions.

FIG. 17 is a flow chart illustrating an embodiment of a method of nighttime image processing for use with the traffic sensing system 32 or 32'. The method illustrated in FIG. 17 can be used at step 232 of FIG. 15.

For each new frame (step 400), a check is performed for ice or snow buildup on the radar (i.e., radome) (step 402). If ice or snow buildup is present, the system 32 or 32' can rely on machine vision data only for detection (step 404). If no ice or snow buildup is present, the system 32 or 32' can rely on the radar for detection (step 406). When radar is used for detection, machine vision can be used for validation or other purposes as well in some embodiments, such as to provide more refined switching.

Examples of possible ways to measure various conditions at the roadway 30 are summarized in Table 2, and are described further below. It should be noted that the examples given in Table 2 and accompanying description generally focus on machine vision and radar sensing modalities, other approaches can be used in conjunction with out types of sensing modalities (LIDAR, etc.), whether explicitly mentioned or not.

TABLE 2

| CONDITION | MEASUREMENT METHOD(S) |
|---|---|
| Strong Shadows | Sun angle calculation |
| | Image processing |
| | Sensing modality count delta |
| Nighttime | Sun angle calculation |
| | Time of day |
| | Image processing |
| Rain/wet road | Image processing (rain) |
| | Image processing (wet road) |
| | Rain signature in radar return |
| | Rain/humidity sensor |
| | Weather service link |
| Occlusion | Geometry |
| Low contrast | Machine vision global contrast detector |
| Traffic Density | Vehicle counts |
| Distance | Measurement |
| Speed | Radar speed |
| | Machine vision speed detector |
| Sensor Movement | Machine vision movement detector |
| | Vehicle track to lane alignment |
| Lane Type | User input |
| | Inference from detector layout and/or configuration |

Strong Shadows

A strong shadows condition generally occurs during daytime when the sun is at such an angle that objects (e.g., vehicles) cast dynamic shadows on a roadway extending significantly outside of the object body. Shadow can cause false alarms with machine vision sensors. Also, applying shadow false alarm filters to machine vision systems can have an undesired side effect of causing missed detections of dark objects. Shadows generally produce no performance degradation for radars.

A multitude of methods to detect shadows with machine vision are known, and can be employed in the present context as will be understood by a person of ordinary skill in the art. Candidate techniques include spatial and temporal edge content analysis, uniform biasing of background intensity, and identification of spatially connected inter-lane objects.

One can also exploit information from multiple sensor modalities to identify detection characteristics. Such methods can include analysis of vision versus radar detection reports. If shadow condition is such that vision-based detection results in a high quantity of false detections, an analysis of vision detection to radar detection count differentials can indicate a shadow condition. Presence of shadows can also be predicted through knowledge of a machine vision sensor's compass direction, latitude/longitude, and date/time, and use of those inputs in a geometrical calculation to find the sun's angle in the sky and to predict if strong shadows will be observed.

Radar can be used exclusively when strong shadows are present (assuming the presence of shadows can reliably be detected) in a preferred embodiment. Numerous alternative switching mechanisms can be employed for strong shadow handling, in alternative embodiments. For example, a machine vision detection algorithm can instead assign a confidence level indicating the likelihood that a detected object is a shadow or object. Radar can be used as a false alarm filter when video detection has low confidence that the detected object is an object and not a shadow. Alternatively, radar can provide a number of radar targets detected in each detector's detection zone (radar targets are typically instantaneous detections of moving objects, which are clustered over time to form radar objects). A target count is an additional parameter that can be used in the machine vision sensor's shadow processing. In a further alternative embodiment, inter-lane communication can be used, using the assumption is that a shadow must have an associated shadow-casting object nearby. Moreover, in yet another embodiment, if machine vision is known to have a bad background estimate, radar can be used exclusively.

Nighttime

A nighttime condition generally occurs when the sun is sufficiently far below the horizon so that the scene (i.e., roadway area at which traffic is being sensed) becomes dark. For machine vision systems alone, the body of objects (e.g., vehicles) becomes harder to see at nighttime, and primarily just vehicle headlights and headlight reflections on the roadway (headlight splash) stand out to vision detectors. Positive detection generally remains high (unless the vehicle's headlights are off). However, headlight splash often causes an undesirable increase in false alarms and early detector actuations. The presence of nighttime conditions can be predicted through knowledge of the latitude/longitude and date/time for the installation location of the system 32 or 32'. These inputs can be used in a geometrical calculation to find when the sun drops below a threshold angle relative to a horizon.

Radar can be used exclusively during nighttime, in one embodiment. In an alternative embodiment, radar can be used to detect vehicle arrival, and machine vision can be used to monitor stopped objects, therefore helping to limit false alarms.

Rain/Wet Road

Rain and wet road conditions generally include periods during rainfall, and after rainfall while the road is still wet. Rain can be categorized by a rate of precipitation. For machine vision systems, rain and wet road conditions cause are typically similar to nighttime conditions: a darkened scene with vehicle headlights on and many light reflections visible on the roadway. In one embodiment, rain/wet road conditions can be detected based upon analysis of machine vision versus radar detection time, where an increased time difference is an indication that headlight splash is activating machine vision detection early. In an alternative embodiment, a separate rain sensor 87 (e.g., piezoelectric or other type) is monitored to identify when a rain event has taken place. In still further embodiments, rain can be detected through machine vision processing, by looking for actual raindrops or optical distortions caused by the rain. Wet road can be detected through machine vision processing by measuring the size, intensity, and edge strength of headlight reflections on the roadway (all of these factors should increase while the road is wet). Radar can detect rain by observing changes in the radar signal return (e.g., increased noise, reduced reflection strength from true vehicles). In addition, rain could be identified through receiving local weather data over an Internet, radio or other link.

In a preferred embodiment, when a wet road condition is recognized, the radar detection can be used exclusively. In an alternative embodiment, when rain exceeds a threshold level (e.g., reliability threshold), machine vision can be used exclusively, and when rain is below the threshold level but the road is wet, radar can be weighted more heavily to reduce false alarms, and switching mechanisms described above with respect to nighttime conditions can be used.

Occlusion

Occlusion refers generally to an object (e.g., vehicle) partially or fully blocking a line of sight from a sensor to a farther-away object. Machine vision may be susceptible to occlusion false alarms, and may have problems with occlusions falsely turning on detectors in adjacent lanes. Radar is much less susceptible to occlusion false alarms. Like machine vision, though, radar will likely miss vehicles that are fully or near fully occluded.

The possibility for occlusion can be determined through geometrical reasoning. Positions and angles of detectors, and a sensor's position, height H, and orientation, can be used to assess whether occlusion would be likely. Also, the extent of occlusion can be predicted by assuming an average vehicle size and height.

In one embodiment, radar can be used exclusively in lanes where occlusion is likely. In another embodiment, radar can be used as a false alarm filter when machine vision thinks an occlusion is present. Machine vision can assign occluding-occluded lane pairs, then when machine vision finds a possible occlusion and matching occluding object, the system can check radar to verify whether the radar only detects an object in the occluding lane. Furthermore, in another embodiment, radar can be used to address a problem of cross traffic false alarms for machine vision.

Low Contrast

Low contrast conditions generally exist when there is a lack of strong visual edges in a machine vision image. A low contrast condition can be caused by factors such as fog, haze, smoke, snow, ice, rain, or loss of video signal. Machine vision detectors occasionally lose the ability to detect vehicles in low-contrast conditions. Machine vision systems can have the ability to detect low contrast conditions and force detectors into a failsafe always-on state, though this presents traffic flow inefficiency at an intersection. Radar should be largely unaffected by low-contrast conditions. The only exception for radar low contrast performance is heavy rain or snow, and especially snow buildup on a radome of the radar; the radar may miss objects in those conditions. It is possible to use an external heater to prevent snow buildup on the radome.

Machine vision systems can detect low-contrast conditions by looking for a loss of visibility of strong visual edges in a sensed image, in a known manner. Radar can be relied upon exclusively in low contrast conditions. In certain weather conditions where the radar may not perform adequately, those conditions can be detected and detectors placed in a failsafe state rather than relying on the impaired radar input, in further embodiments.

Sensor Failure

Sensor failure generally refers to a complete dropout of the ability to detect for a machine vision, radar or any other sensing modality. It can also encompass partial sensor failure. A sensor failure condition may occur due to user error, power outage, wiring failure, component failure, interference, software hang-up, physical obstruction of the sensor, or other causes. In many cases, the sensor affected by sensor failure can self-diagnose its own failure and provide an error flag. In other cases, the sensor may appear to be running normally, but produce no reasonable detections. Radar and machine vision detection counts can be compared over time to detect these cases. If one of the sensors has far less detections than the other, that is a warning sign that the sensor with less detections may not be operating properly. If only one sensor fails, the working (i.e., non-failed) sensor can be relied upon exclusively. If both sensors fail, usually nothing can be done with respect to switching, and outputs can be set to a fail-safe, always on, state.

Traffic Density

Traffic density generally refers to the rate of vehicles passing through an intersection or other area where traffic is being sensed. Machine vision detectors are not greatly affected by traffic density. There are an increased number of sources of shadows, headlight splash, or occlusions in high traffic density conditions, which could potentially increase false alarms. However, there is also less practical opportunity for false alarms during high traffic density conditions because detectors are more likely to be occupied by a real object (e.g., vehicle). Radar generally experiences reduced performance in heavy traffic, and is more likely to miss objects in heavy traffic conditions. Traffic density can be measured by common traffic engineering statistics like volume, occupancy, or flow rate. These statistics can easily be derived from radar, video, or other detections. In one embodiment, machine vision can be relied upon exclusively when traffic density exceeds a threshold.

Distance

Distance generally refers to real-world distance from the sensor to the detector (e.g., distance to the stop line $D_S$). Machine vision has decent positive detection even at relatively large distances. Maximum machine vision detection range depends on camera angle, lens zoom, and mounting height H, and is limited by low resolution in a far-field range. Machine vision usually cannot reliably measure vehicle distances or speeds in the far-field, though certain types of false alarms actually become less of a problem in the far-field because the viewing angle becomes nearly parallel to the roadway, limiting visibility of optical effects on the roadway. Radar positive detection falls off sharply with distance. The rate of drop-off depends upon the elevation angle β and mounting height of the radar sensor. For example, a radar may experience poor positive detection rates at distances significantly below a rated maximum vehicle detection range. The distance of each detector from the sensor can be readily determined through the system's 32 or 32' calibration and normalization data. The system 32 or 32' will know the real-world distance to all corners of the detectors. Machine vision can be relied on exclusively when detectors exceed a maximum threshold distance to the radar. This threshold can be adjusted based on the mounting height H and elevation angle β of the radar.

Speed

Speed generally refers to a speed of the object(s) being sensed. Machine vision is not greatly affected by vehicle speed. Radar is more reliable at detecting moving vehicles because it generally relies on the Doppler effect. Radar is usually not capable of detecting slow-moving or stopped objects (below approximately 4 km/hr or 2.5 ml/hr). Missing stopped objects is less than optimal, as it could lead an associated traffic controller 86 to delay switching traffic lights to service a roadway approach 38, delaying or stranding drivers. Radar provides speed measurements each frame for each sensed/tracked object. Machine vision can also measure speeds using a known speed detector. Either or both mechanism can be utilized as desired. Machine vision can be used for stopped vehicle detection, and radar can be used for moving vehicle detection. This can limit false alarms for moving vehicles, and limit missed detections of stopped vehicles.

Sensor Movement

Sensor movement refers to physical movement of a traffic sensor. There are two main types of sensor movement: vibrations, which are oscillatory movements, and shifts, which are a long-lasting change in the sensor's position. Movement can be caused by a variety of factors, such as wind, passing traffic, bending or arching of supporting infrastructure, or bumping of the sensor. Machine vision sensor movement can cause misalignment of vision sensors with respect to established (i.e., fixed) detection zones, creating a potential for both false alarms and missed detections. Image stabilization onboard the machine vision camera, or afterwards in the video processing, can be used to lessen the impact of sensor movement. Radar may experience errors in its position estimates of objects when the radar is moved from its original position. This could cause both false alarms and missed detections. Radar may be less affected than machine vision by sensor movements. Machine vision can provide a camera movement detector that detects changes in the camera's position through machine vision processing. Also, or in the alternative, sensor movement of either the radar or machine vision device can be detected by comparing positions of radar-tracked vehicles to the known lane boundaries. If vehicle tracks don't consistently align with the lanes, then it is likely a sensor's position has been disturbed.

If only one sensor has moved, then the other sensor can be used exclusively. Because both sensors are linked to the same enclosure, it is likely both will move simultaneously. In that case, the least affected sensor can be weighted more heavily or even used exclusively. Any estimates of the motion as obtained from machine vision or radar data can be used to determine which sensor is most affected by the movement. Otherwise, radar can be used as the default when significant movement occurs. Alternatively, a motion estimate based on machine vision and radar data can be used to correct the detection results of both sensors, in an attempt to reverse the effects of the motion. For machine vision, this can be done by applying transformations to the image (e.g., translation, rotation, warping). With radar, it can involve transformations to the position estimate of vehicles (e.g., rotation only). Furthermore, if all sensors have moved significantly such that part of the area-of-interest is no longer visible, then affected detectors can be placed in a failsafe state (e.g., a detector turned on by default).

Lane Type

Lane type generally refers to the type of the lane (e.g., thru-lane, turn-lane, or mixed use). Machine vision is usually not greatly affected by the lane type. Radar generally performs better than machine vision for thru-lanes. Lane type can be inferred from phase number or relative position of the lane to other lanes. Lane type can alternatively be explicitly defined by a user during initial system setup. Machine vision can be relied upon more heavily in turn lanes to limit misses of stopped objects waiting to turn. Radar can be relied upon more heavily in thru lanes.

Concluding Summary

The traffic sensing system 32 can provide improved performance over existing products that rely on video detection or radar alone. Some improvements that can be made possible with a hybrid system include improved traditional vehicle classification accuracy, speed accuracy, stopped vehicle detection, wrong way vehicle detection, vehicle tracking, cost savings, and setup. Also, improved positive detection, decreased false detection is made possible. Vehicle classification is difficult during nighttime and poor weather conditions because machine vision may have difficulty detecting vehicle features; however, radar is unaffected by most of these conditions and thus can generally improve upon basic classification accuracy during such conditions despite known limitations of radar at measuring vehicle length. While one version of speed detector integration improves speed measurement through time of day, distance and other approaches, another syllogism can further improve speed detection accuracy by seeking out a combination process for using multiple modalities (e.g., machine vision and radar) simultaneously. For stopped vehicles, a "disappearing" vehicle in Doppler radar (even with tracking enabled) often occurs when an object (e.g., vehicle) slows to less than approximately 4 km/hr. (2.5 ml/hr.), though integration of machine vision and radar technology can help maintain detection until the object starts moving again and also to provide the ability to detect stopped objects more accurately and quickly. For wrong way objects (e.g., vehicles), the radar can easily determine if an object is traveling the wrong way (i.e., in the wrong direction on a one-way roadway) via Doppler radar, with a small probability of false alarm. Thus, when normal traffic is approaching from, for example, a one-way freeway exit, the system could provide an alert alarm when a driver inadvertently drives the wrong way onto the freeway exit ramp. For vehicle tracking through data fusion, the machine vision or radar outputs are chosen, depending on lighting, weather, shadows, time of day and other factors, enabling the HDM 90-1 to **90-*n*** to map coordinates of radar objects into a common reference system (e.g., universal coordinate system), in the form of a post-algorithm decision logic. Increased system integration can help limit cost and improve performance. The cooperation of radar and machine vision while sharing common components such as power supply, I/O and DSP in further embodiments can help to reduce manufacturing costs further while enabling continued performance improvements. With respect to automatic setup and normalization, the user experience is benefited by a relatively simple and intuitive setup and normalization process.

Any relative terms or terms of degree used herein, such as "substantially", "approximately", "essentially", "generally" and the like, should be interpreted in accordance with and subject to any applicable definitions or limits expressly stated herein. In all instances, any relative terms or terms of degree used herein should be interpreted to broadly encompass any relevant disclosed embodiments as well as such ranges or variations as would be understood by a person of ordinary skill in the art in view of the entirety of the present disclosure, such as to encompass ordinary manufacturing tolerance variations, sensor sensitivity variations, incidental alignment variations, and the like.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims. For example, features of various embodiments disclosed above can be used together in any suitable combination, as desired for particular applications.

The invention claimed is:

1. A traffic sensing system for sensing traffic at a roadway, the system comprising:

a first sensor having a first field of view;

a second sensor having a second field of view, wherein the first and second fields of view at least partially overlap in a common field of view over a portion of the roadway, wherein the first sensor and the second sensor are different types of sensors that together provide input of different sensing modalities in a hybrid mode to a hybrid detection module for individual processing; and a controller configured to process output of the hybrid detection module to:

normalize different coordinate systems of the first and second fields of view so locations in the first and second fields of view are usable together and interchangeably; and select a sensor data stream for at least a portion of the common field of view from the different sensing modalities of the different first and/or second sensor types as a function of operating conditions at the roadway based upon post-processing of normalized data streams from the different sensing modalities, in order to provide roadway traffic detection, wherein the operating conditions include variations of lighting and visibility of an object determined from the normalized data streams.

2. The system of claim 1, wherein the controller is further configured to select a sensor data stream for at least a portion of the common field of view as a function of type of detection.

3. The system of claim 1, wherein the first and second sensors are located adjacent to one another and are both commonly supported by a support structure.

4. The system of claim 1, wherein the portion of the roadway over which the respective first and second fields of view of the first and second sensors at least partially overlap include a detection region of interest within a first approach.

5. The system of claim 1, wherein the controller is configured to select a sensor data stream from the different sensing modalities of the first or second sensor as a function of the variations of the lighting and the visibility of the object at the roadway that include presence of shadows, daytime or nighttime lighting, rain and wet road conditions, contrast, field of view occlusion, traffic density, and sensor-to-object distance.

6. The system of claim 5, wherein the first sensor is a radar and the second sensor is a machine vision device, and wherein the controller is configured to select the machine vision device by default and use radar together with machine vision based upon the post-processing to improve detection under operating conditions that include low contrast, strong shadow, nighttime, queues, and weather conditions that decrease machine vision performance.

7. The system of claim 1, wherein the controller is configured to select based upon the post-processing a sensor data stream from the different sensing modalities of the first and/or second sensor as a function of type of detection of: object count, object speed, stop line detection, lane type, lane boundaries, object presence in a selected area, queue length, turn movement detection, object classification, and object directional warning.

8. The system of claim 1, wherein the first sensor comprises a radar assembly as the first sensor type of a first sensing modality, and wherein the second sensor comprises a machine vision assembly as the second sensor type of a second sensing modality.

9. A method of normalizing a traffic sensor system for sensing traffic at a roadway, the method comprising:

positioning a first synthetic target generator device on or near the roadway;

sensing roadway data with a first sensor having a first sensor coordinate system;

sensing roadway data with a second sensor having a second sensor coordinate system, wherein the sensed roadway data of the first and second sensors overlap in a first roadway area, and wherein the first synthetic target generator device is positioned in the first roadway area;

detecting a location of the first synthetic target generator device in the first sensor coordinate system with the first sensor;

displaying sensor output of the second sensor;

selecting a location of the first synthetic target generator device on the display in the second sensor coordinate system; and correlating the first and second coordinate systems as a function of the locations of the first synthetic target generator device in the first and second sensor coordinate systems.

10. The method of claim 9 and further comprising:

positioning a second synthetic target generator device on or near the roadway;

detecting a location of the second synthetic target generator device in the first sensor coordinate system with the first sensor; and selecting a location of the second synthetic target generator device on the display in the second sensor coordinate system, wherein correlating the first and second coordinate systems is also performed as a function of the locations of the second synthetic target generator device in the first and second sensor coordinate systems.

11. The method of claim 10 and further comprising:

positioning a third synthetic target generator device on or near the roadway detecting a location of the third synthetic target generator device in the first sensor coordinate system with the first sensor; and selecting a location of the third synthetic target generator device on the display in the second sensor coordinate system, wherein correlating the first and second coordinate systems is also performed as a function of the locations of the third synthetic target generator device in the first and second sensor coordinate systems.

12. The method of claim 11, wherein the first, second and third synthetic target generator devices are the same device repositioned at different physical locations on the roadway.

13. The method of claim 11, wherein the first, second and third synthetic target generator devices are simultaneously positioned at different physical locations on the roadway.

14. The method of claim 9, wherein the first synthetic target generator device is held in a stationary position relative to the roadway.

15. A traffic sensing system and normalization kit for use at a roadway, the kit comprising:

a first synthetic target generator device that is positionable on or near the roadway;

a radar sensor having a first field of view that is positionable at the roadway;

a machine vision sensor having a second field of view that is positionable at the roadway; and a communication device configured to communicate data from the first and second sensors to a display.

16. The kit of claim 15, wherein the first synthetic target generator device comprises a mechanical or electro-mechanical device having moving element.

17. The kit of claim 15, wherein the first synthetic target generator device comprises an electrical device that generates an electromagnetic wave to simulate a reflected radar return wave.

18. The kit of claim 15, wherein the radar sensor and the machine vision sensor are secured adjacent one another in a common hybrid sensor assembly.

19. The kit of claim 15 and further comprising:

a terminal operably connectable to the communication system to allow operator input.

20. The method of claim 11, wherein the first, second and third synthetic target generator devices are not positioned collinearly.

* * * * *